US007036886B2

(12) United States Patent
Benden et al.

(10) Patent No.: US 7,036,886 B2
(45) Date of Patent: May 2, 2006

(54) SUPPORT ASSEMBLY FOR A SEATING DEVICE

(75) Inventors: Mark E Benden, College Station, TX (US); Christopher A. Smith, Bryan, TX (US); Jerome J Congleton, College Station, TX (US); Larry Johnson, Bryan, TX (US)

(73) Assignee: Neutral Posture, Inc., Bryan, TX (US)

( * ) Notice: Subject to any disclaimer, the term of this patent is extended or adjusted under 35 U.S.C. 154(b) by 0 days.

(21) Appl. No.: 10/835,170

(22) Filed: Apr. 29, 2004

(65) Prior Publication Data

US 2005/0253441 A1 Nov. 17, 2005

(51) Int. Cl.
*A47C 7/50* (2006.01)

(52) U.S. Cl. ..... 297/423.25; 297/423.21; 297/423.37; 297/423.4

(58) Field of Classification Search ..... 108/140, 108/151, 152, 50.14, 108, 102, 137; 248/188.7, 248/188.8, 188.9; 297/423.1, 423.21, 423.25, 297/423.37, 423.4, 423.18, 240, 241, 142, 297/173, 188.2, 463.1, 463.2, 188.21, 170, 297/195.13

See application file for complete search history.

(56) References Cited

U.S. PATENT DOCUMENTS

| | | | | |
|---|---|---|---|---|
| 344,675 | A | 6/1886 | Ordway | |
| 1,030,876 | A * | 7/1912 | Derry | 108/9 |
| 1,933,096 | A | 10/1933 | Child | 155/165 |
| 2,358,399 | A * | 9/1944 | Kelly | 297/209 |
| 2,529,780 | A | 11/1950 | Miller | 155/95 |
| 2,557,232 | A * | 6/1951 | Morgan | 297/241 |
| 2,572,874 | A * | 10/1951 | MacKnight | 297/241 |
| 2,620,863 | A * | 12/1952 | Cooper | 297/188.2 |
| 3,057,670 | A * | 10/1962 | Russo | 108/48 |
| 3,820,844 | A * | 6/1974 | Fortnam | 297/423.37 |
| 4,023,859 | A | 5/1977 | Hagenson | 297/158 |
| 4,119,286 | A | 10/1978 | Barril | 248/188 |
| 4,171,847 | A | 10/1979 | Tukui | 297/5 |
| 4,753,407 | A * | 6/1988 | Brock | 248/346.01 |
| 4,767,160 | A * | 8/1988 | Mengshoel et al. | 297/423.12 |

(Continued)

FOREIGN PATENT DOCUMENTS

GB 326850 3/1930

OTHER PUBLICATIONS

3M Adjustable Footrest information available on the world wide web on Dec. 22, 1998 at 3M's home page at: www.3m.com/market/omc/catalog/products/p00/p22/p83.html.

(Continued)

*Primary Examiner*—Peter M. Cuomo
*Assistant Examiner*—Sarah B. McPartlin
(74) *Attorney, Agent, or Firm*—Howrey LLP

(57) ABSTRACT

An adjustable support assembly is described for use with any prior art seating device having a post and a plurality of substantially horizontal legs. In some embodiments, the support assembly has a support with at least two voids for mounting to the post of the seating device, and at least one leg. The outer perimeter of the support is moveable outwardly with respect to the post of the seating device via selective engagement with one of the voids. Further, the attachment of the legs to the support provides a way to selectively lock the support to prevent rotation of the support about the post. A method of adjusting the support is also disclosed.

37 Claims, 22 Drawing Sheets

U.S. PATENT DOCUMENTS

| | | | | | |
|---|---|---|---|---|---|
| D298,355 | S | * | 11/1988 | Young | D24/128 |
| 4,915,450 | A | | 4/1990 | Cooper | 297/423 |
| 4,984,761 | A | * | 1/1991 | Chen | 248/188.7 |
| 5,098,160 | A | | 3/1992 | Moore et al. | 247/423 |
| 5,174,631 | A | * | 12/1992 | Schaevitz | 297/423.19 |
| 5,344,217 | A | | 9/1994 | McLaughlin | 297/423.25 |
| 5,390,798 | A | * | 2/1995 | Yanuzzi | 206/562 |
| 5,419,618 | A | | 5/1995 | Hatcher | 297/423.46 |
| 5,501,419 | A | | 3/1996 | Huang | 248/188.7 |
| 5,577,806 | A | | 11/1996 | Ugalde | 297/423.46 |
| 5,660,432 | A | * | 8/1997 | Davis | 297/182 |
| 5,667,272 | A | * | 9/1997 | Sutton | 297/140 |
| D401,088 | S | | 11/1998 | Chen | 297/423.4 |
| 5,836,555 | A | * | 11/1998 | Ellsworth et al. | 248/161 |
| 5,865,124 | A | * | 2/1999 | Wroe | 108/26 |
| 5,918,550 | A | * | 7/1999 | Weir et al. | 108/42 |
| 6,142,571 | A | | 11/2000 | Benden | D6/498 |
| 6,336,412 | B1 | * | 1/2002 | Heimbrock et al. | 108/42 |
| 6,607,246 | B1 | * | 8/2003 | Benden | 297/423.4 |
| 6,634,716 | B1 | * | 10/2003 | Sander et al. | 297/423.19 |
| 6,648,417 | B1 | * | 11/2003 | Gilbert et al. | 297/423.25 |
| 2004/0070241 | A1 | * | 4/2004 | Ventimiglia et al. | 297/217.1 |

OTHER PUBLICATIONS

Neutral Posture "Adapta Series" information available on the world wide web on Apr. 28, 2004 at: www.igoergo.com/products/harvard_seating/industrial/adaptaseries.html.

Neutral Posture "Round Stool" information available on the world wide web on Apr. 28, 2004 at: www.igoergo.com/products/harvard_seating/industrial/round_stool.html.

* cited by examiner

SUPPORT ASSEMBLY FOR A SEATING DEVICE

BACKGROUND OF THE INVENTION

1. Field of the Invention

The invention relates to an adjustable support assembly for a prior art seating device, such as a stool or chair. More particularly, this invention relates to an adjustable support assembly adapted to support the feet of a user of the seating device in an ergonomically correct position. The support assembly may be adjusted toward or away from the post of the seating device, so the support assembly may be utilized with a variety of standard sizes of seating devices. Further, the legs of the support assembly may be positioned on the support to selectively lock the support to prevent rotation of the support with respect to the chair.

2. Description of the Related Art

In the workplace, persons are often required to perform repetitive manual tasks in a sedentary position. By maintaining a sedentary position throughout the workday, the person can become fatigued without proper support. Remaining in that sedentary position may reduce blood flow through the legs as well. Utilizing ergonomic principles when designing furniture may increase worker productivity, decrease worker fatigue and absenteeism, and improve blood flow throughout the body.

A stool differs from an industrial chair in the workplace. A stool is designed to support a user, such that the user's feet do not touch the floor. A chair, on the other hand, is adapted to support a user such that his or her feet at least partially contact the floor. As such, stools may be utilized in situations that have a higher working area than do chairs.

Standard height workstations for seated tasks are typically at or below 30" to the top surface. Traditional industrial stools for users in the laboratory and manufacturing environment are generally designed to elevate a worker to a non-standard height workstation. As workstation height and therefore working height is increased, the surface of the seating device must be raised to a level where foot contact with the floor is no longer possible for most of the population. This range of seating is generally classified as "stools," as opposed to industrial chairs, etc.

Prior art stools, chairs, and other seating devices typically are comprised of a plurality of legs, generally five, dispersed in wagon-wheel fashion in a substantially-horizontal plane. A castor is typically provided at the end of each leg, which allows the stool to be moved relatively easily. In the center of the legs is located a post, having a neck toward the top of the post. A seat is located atop the post. Generally, the seat is adjustable on the post such that the height of the seat may be adjusted. Thus, the same stool may be used by more than one user, or for use by the same user various working levels.

In some prior art stools, the user's feet are not supported at all. Thus, the circulation through the legs of the user is hampered. This configuration is less than ideal, the circulation being minimized in the user's legs.

In other prior art stools, it is known to provide a support foot ring (generally comprised of metal, such as chrome) to support the user's feet. In some systems, the standard foot ring surfaces are chrome hoops of steel tubing. These hoops provide little traction due the low coefficient of friction of chrome surfaces. Stools or other seating devices may be equipped with foot rings attached to the lift-cylinder column or center post of the stool. These foot rings are typically capable of being locked at various heights (as indicated by the type of work being performed by the user) by hand tightening a friction clamp via a knob located near the center of the foot ring and adjacent to the lift column.

However, the extent the clamp secures the footrest at a given height on the post of the stool, chair, or seating device is dependent on the strength of the user tightening the clamp. Additionally, over time, these clamps may tend to wear and therefore may fail to maintain the desired height.

Several attempts to design footrests that clamp better have been made in the past. For example, some prior art systems include a base with certain fixed-height elements, such as legs, around the perimeter of the base. These bases or pedestals generally are not adjustable and are relatively permanently affixed to the chairs. Thus, the user must select the proper stool, chair, or other seating device with the proper pedestal for a given task closest to that for the desired work height. This approach may prove costly because of the materials needed to provide sufficient support for the user's feet forces seen in normal use. Further, these systems lack the adjustability, so multiple chairs are needed if all users are to be in ergonomically-correct orientations during work.

Also, prior art supports generally are not designed to rotate about the post of the stool. It would be desirable to provide a foot support capable of rotation around the base about the post. It would be desirable to have various platforms of different heights in stair-stepping fashion.

Further efforts to increase the use of prior art foot rings include increasing the diameter of the foot ring. However, if the diameter of the foot ring is increased excessively, then when a user applies weight to the foot ring when exiting the seating device, the entire seating device may tend to tilt or tip over. Thus, a need exists to provide an adjustable assembly for a seating device that is less likely to cause the seating device to become unstable and/or tilt than prior art attempts.

Further, there exists a need for an apparatus that may serve as a retrofit kit for existing stools in the field that would maintain the desirable features of providing a support at multiple heights. Such an apparatus would be preferably manufacturable at low cost. Further, it is desirable that such an apparatus could be assembled to existing stools, chairs, or other seating devices with no tools required, and with no disassembly of the stool, chair, or seating device required (e.g. removal of the seat to install the apparatus). Further, the apparatus should be versatile such that the apparatus is adapted to accommodate many prior art stool, chair, or other seating device configurations currently in use.

SUMMARY OF THE INVENTION

A support apparatus or assembly for a seating device is described. In some embodiments, the plurality of supports are stackable. The stackable support assembly for seating devices may be added to any standard base and lift column or post of prior art seating devices. One, two or three sections may be added to the lift column or post depending on the travel range of the lift. The supports provide equidistant changes in height from one level to the next. Two- or three-inch changes may be appropriate for standard stool or seating device lift ranges and the normal variance seen in the seated popliteal heights of typical users ($5^{th}$ percentile female—$95^{th}$ percentile male). By relying only on gravity and friction for strength and engagement, the height of the support assembly design may be minimally affected by time and use.

Foot contact area is greatly enhanced with this approach since traditional foot rings concentrate foot forces over the tangent of ½"–2" rings. This tangent area is considerably less than the 72 square inches of available feet area afforded by the disclosed support assembly. Additionally, the foot ring diameters of 16"–20" are significantly less than the diameters of common bases that range from 22"–28". By failing to utilize the full diameter of the base to support the feet, the popliteal angle is compromised to less than 90 degrees and depending on seat pan depth and design, may cause significant decreases in the blood flow to the lower legs of the user. This posture is not encouraged for task level seating yet for some reason it is standardized for stool level seating.

In some embodiments, the footrest assembly or apparatus provides tread surfaces built into the construction material to reduce slips and to decrease fatigue normally encountered while using foot rings.

Although the support assembly described herein with respect to applications with stools, the support assembly is equally capable of use on chairs, for example, when being utilized by persons of small stature, for example. Thus, the support assembly described herein as "seating device" may be utilized with any type of seating device, i.e. a chair, stool, or any other device for use by a user in the seated position.

In some embodiments, a support assembly is described as being attachable to a center post of a seating device having a plurality of substantially horizontal legs. The support assembly has a support having a first void and a second void therethrough, the support having an end and an outer perimeter; and at least one support leg adapted to be attachable to the support, the first void selectively engaging the post to define a first position of the support, the second void being located between the first void and the outer perimeter, the second void engaging the post to define a second position of the support, such that the perimeter moves outwardly from the post when the support is moved from second position to the first position. The support may be substantially triangular and the end may comprise the apex.

In other embodiments, the support assembly is attachable to a center post of a seating device having a plurality of substantially horizontal legs. In these embodiments, the support assembly has a support attachable to the post, the support having an outer perimeter; and at least one support leg, each support leg selectively connectable to the support at a first location, each leg also connectable to the support at a second location between the first location and the outer perimeter, wherein the support is rotatable about the post when the support leg is connected to the support at the second location, the support substantially prevented from rotating about the post when the support leg is connected to the support at the first location.

A method of adjusting a support assembly of a seating device is also provided.

BRIEF DESCRIPTION OF THE DRAWINGS

FIG. 2A shows a top perspective view an embodiment having a support assembly.

FIG. 2B shows a top view of the embodiment of FIG. 2A.

FIG. 2C shows a bottom perspective view of the embodiment of FIG. 2A.

FIG. 2D shows a bottom view of the embodiment of FIG. 2A.

FIG. 2E shows a side view of the embodiment of FIG. 2A.

FIG. 2F shows a front view of the embodiment of FIG. 2A.

FIG. 2G shows the embodiment of FIG. 2A installed on a seating device.

FIG. 3A shows a top view of an embodiment of the present invention showing support on a base of a prior art seating device.

FIG. 3B shows a side view of the embodiment of FIG. 3A.

FIG. 3C shows a bottom view of the embodiment of FIG. 3A.

FIG. 5A shows a top perspective view of a plurality of supports of an embodiment of the present invention mounted to a prior art base for a seating device.

FIG. 5B shows a top view of the embodiment of FIG. 5B.

FIG. 5C shows a bottom perspective view of the embodiment of FIG. 5A.

FIG. 6A shows an embodiment having a first void and a second void.

FIG. 6B shows a side view of the embodiment of FIG. 6A.

FIG. 6C shows a front view of the embodiment of FIG. 6A.

FIG. 6D shows the bottom view of the embodiment of FIG. 6A.

FIG. 6E shows the bottom view of the embodiment of FIG. 6A with the support straddling a leg of a prior art seating device.

FIG. 8A shows the side view of an embodiment of the present invention having a plurality of stackable supports.

FIG. 8B shows a front view of the embodiment of FIG. 8A.

FIG. 8C shows a perspective view of the embodiment of the stackable supports of FIG. 8A wherein the supports comprise a stair step.

FIG. 8D shows the embodiment of FIG. 8A installed on a seating device.

Figure 1A:
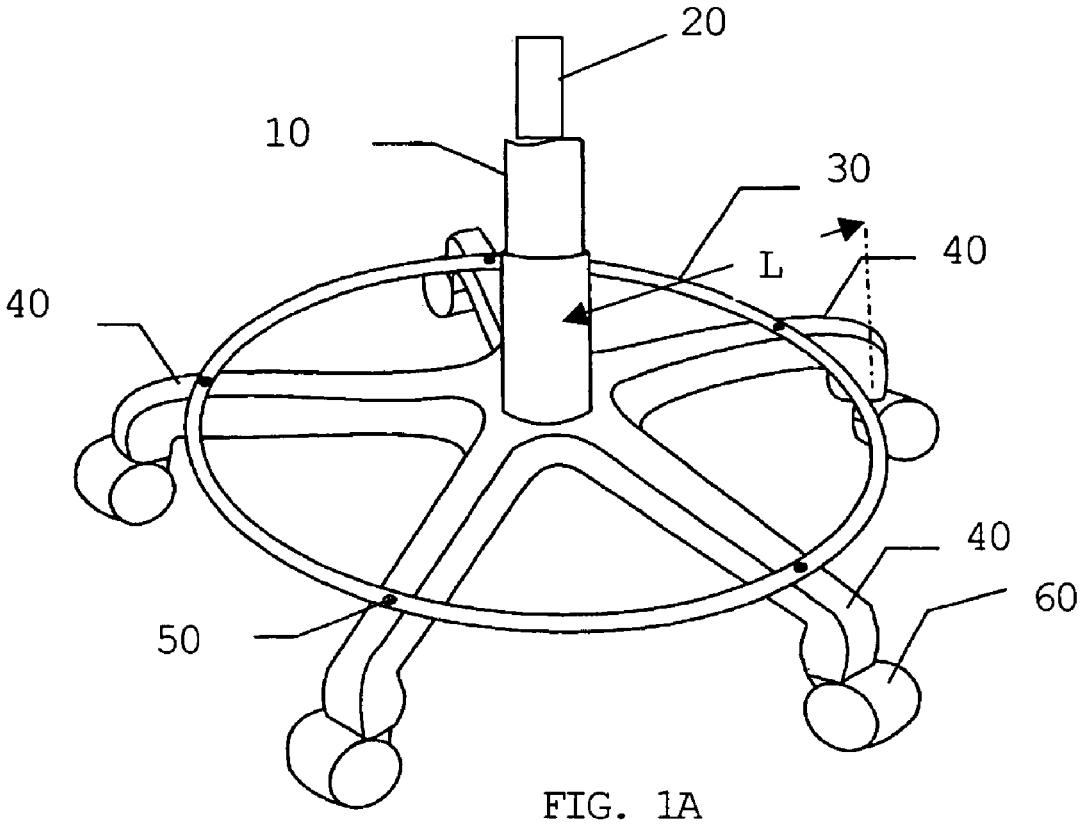
FIG. 1A (Prior Art)
FIG. 1A shows the base for a prior art seating device.

While the invention is susceptible to various modifications and alternative forms, specific embodiments have been shown by way of example in the drawings and will be described in detail herein. However, it should be understood that is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

The invention relates to an adjustable support assembly for a prior art seating device. The support assembly is adjustable such that it is capable of being retrofitted for various prior art seating devices such as chairs or stools. Further, the support assemblies disclosed herein may be relatively-easily installed without the use of tools. The disclosed support assembly may be injected molded to minimize manufacturing costs. Further, the disclosed support is rotatable and adjustable away from the post to provide enhanced versatility from one piece of equipment.

Illustrative embodiments of the invention are described below as they might be employed in the use of an adjustable support assembly that can be utilized with any prior art seating device, such as a stool or chair, to support a user's feet in a variety of different configurations. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 1B:
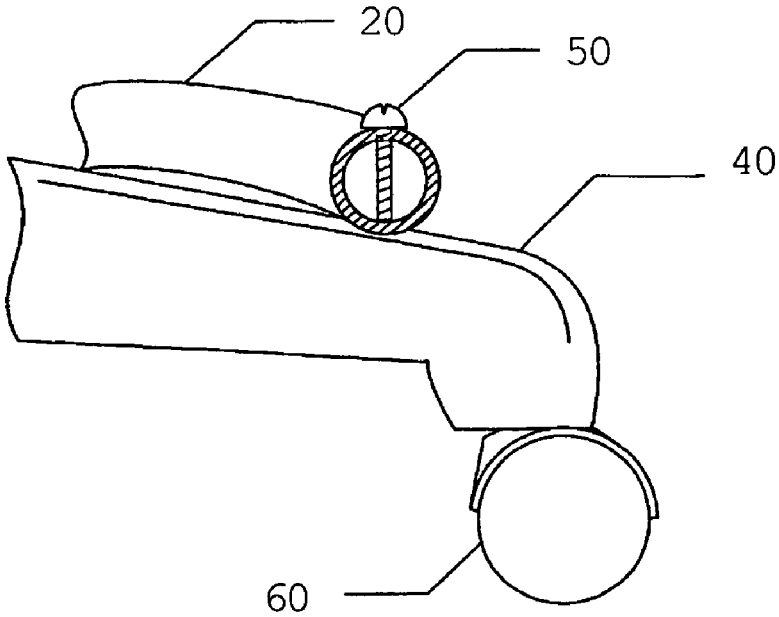
FIG. 1B (Prior Art)
FIG. 1B shows a side view of the base of FIG. 1A.

Further aspects and advantages of the various embodiments of the invention will become apparent from consideration of the following description and drawings. Referring to FIGS. 1A and 1B, a base 1 for a prior art industrial seating device, such as a stool or a chair, is shown to be made up of substantially horizontal legs having a length L. In this typical example, the five substantially horizontal legs 40 meet at and support a post 10 having a neck 20. The neck 20 has a smaller diameter than the post 10. A seating device (not shown) is attachable to neck 20. On the perimeter of each leg is a caster 60. Also shown in FIGS. 1A and 1B is a prior art foot ring 30. Foot ring 30 is mounted on the legs 40 by fasteners 50. As shown in FIG. 1A, the foot ring 30 circumscribes the base around the legs 40. FIG. 1B shows a side view of the embodiment of FIG. 1A. In operation, a person rests his or her feet on the foot ring. However, as mentioned above, these prior art foot rings 30 are not adjustable and may not provide proper ergonomic support for a user seated in the seating device of the prior art.

Now referring to FIGS. 2A–2F, an embodiment of the present invention is shown as a support assembly 100. As shown in these figures, the support assembly 100 is comprised of a substantially triangularly-shaped support 101 having an apex A and an outer perimeter 130. Of course, the support 101 is not limited to the substantially triangular shape, as any shape known to one of ordinary skill in the art could be utilized effectively.

Located substantially near apex A is a first void 110. Located between the first void and the outer perimeter is a second void 120. In this embodiment, an intermediate void 115 is located between the first void 110 and the second void 120, although such an intermediate void 115 is not necessary. Alternatively, additional intermediate voids may similarly be provided.

A slot S is adapted to provide communication from the apex through the first void into the second void 120. In this example, the slot S also passes through intermediate void 115. In the example shown in FIGS. 2A–2F, each void 110, 115 and 120 comprises a substantially circular outer diameter. In some embodiments, the support assembly 100 may comprise traction grooves 140 in support 101. In the example shown in FIG. 2A, a total of six traction grooves are shown, each being radial from the apex A.

Figure 2A:
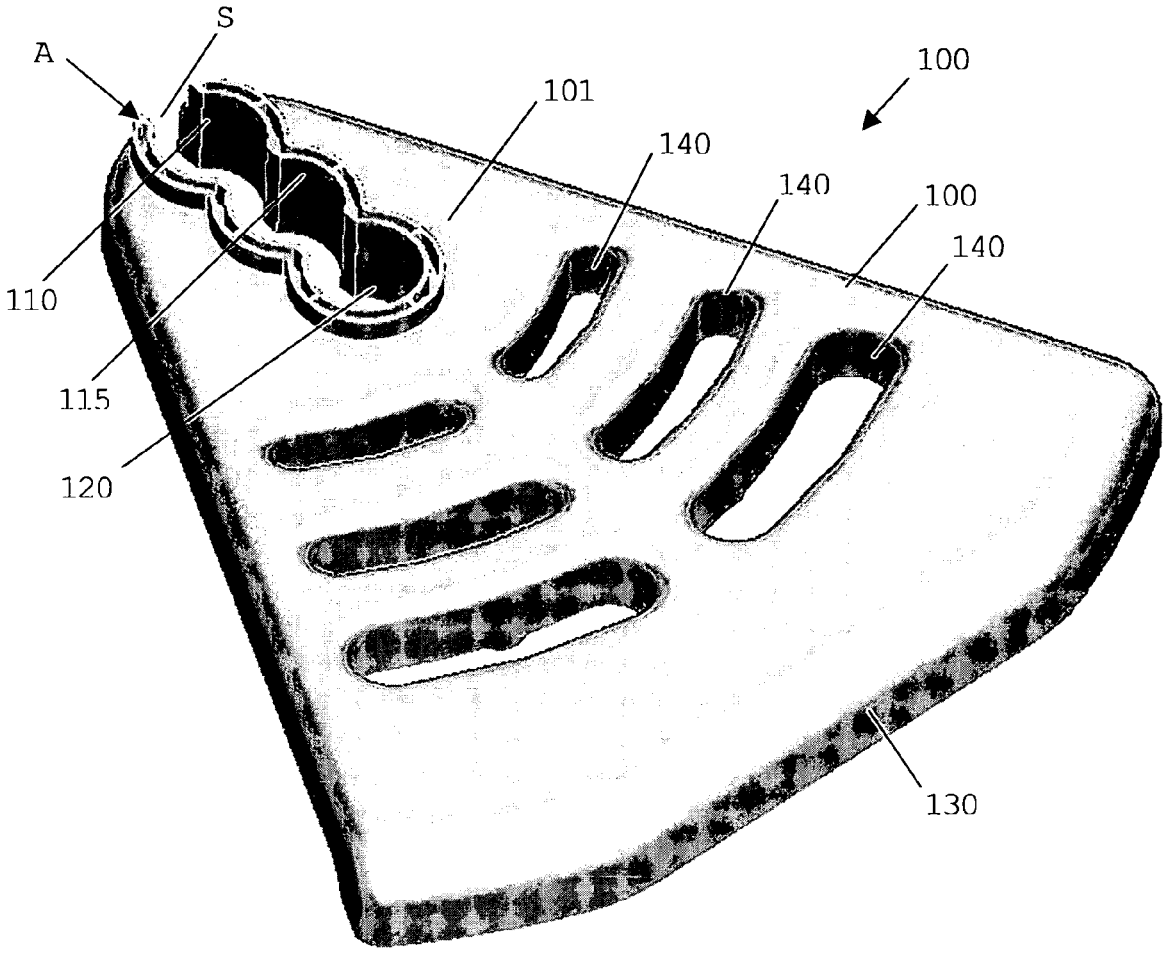
FIGS. 2A–2G show one embodiment of the present invention having a support assembly.
Figure 2B:
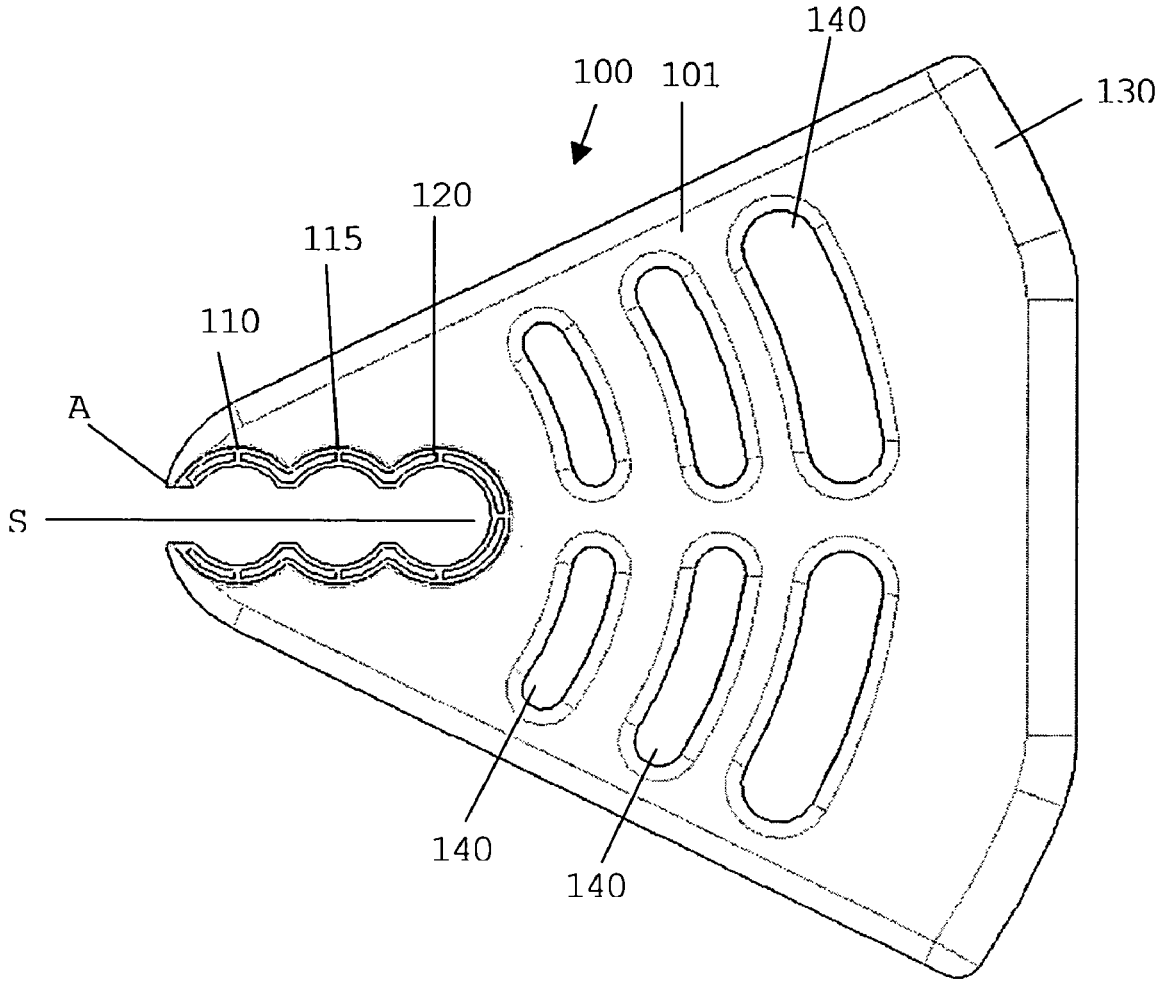

FIG. 2B shows a top view of the embodiment of FIG. 2A and also more clearly shows the slot S providing communication from the apex through the voids 5 and 120.

Figure 2C:
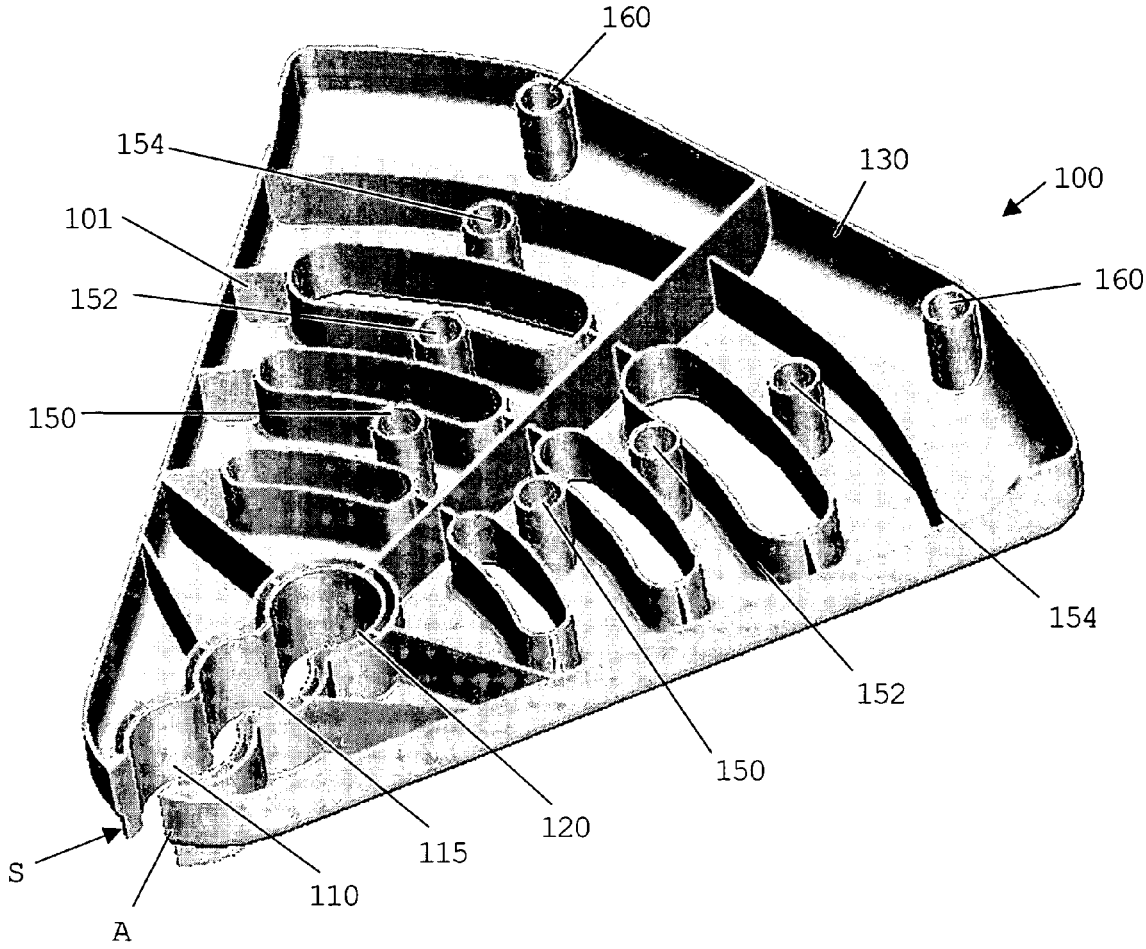

Referring to FIG. 2C, a bottom perspective view of the embodiment of Figure of 2A is shown. As can be seen, a plurality of leg sockets 150, 152, 154, and 160 are provided from the bottom of support 101, as will be described more thoroughly herinafter. Each leg socket is adapted to accommodate a support leg 170, as described more thoroughly hereinafter.

As shown in FIG. 2C, a pair of outer leg sockets 160 are provided substantially adjacent the outer perimeter 130 of support 101. Located inwardly from support 160 towards the apex A is a pair of inner leg sockets 150. In the embodiment of FIG. 2C, two pairs of intermediate leg sockets 152 and 154 are provided between the pair of inner leg sockets 150 and the outer leg sockets 160.

Figure 2D:
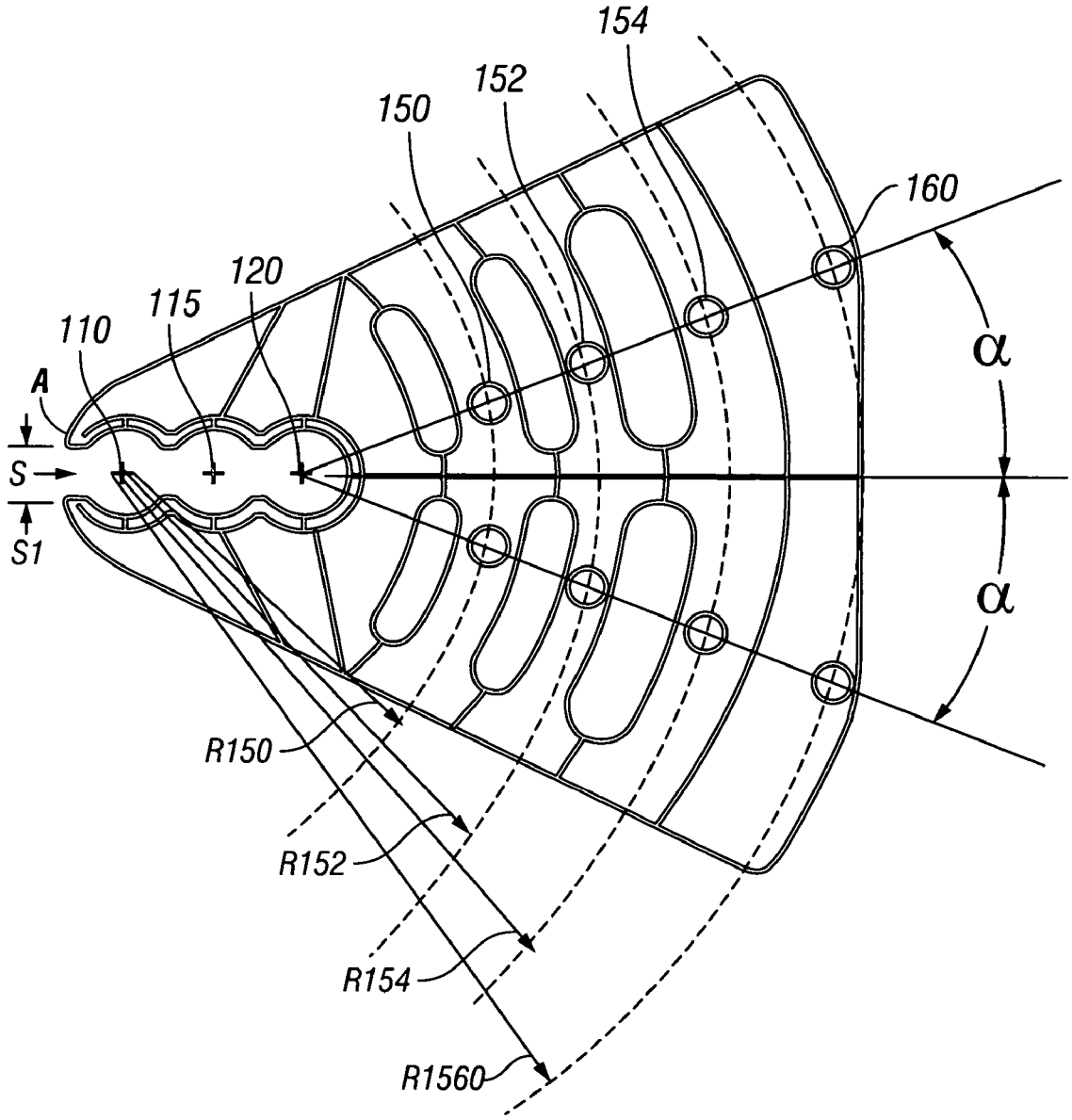

Referring to FIG. 2D, the bottom view is shown for the support 101 of FIG. 2A. FIG. 2D shows exemplary dimensions for this embodiment of the present invention. Each of the first void 110, second void 120 and intermediate void 115 have a diameter of approximately two inches and are adapted to accommodate a typical standard prior art center post 10 having approximately the same diameter. This slot S in this embodiment has a width S1 of 1.1 inches.

A pair of inner leg sockets 150 is positioned at a radius of $R_{150}$ as measured from the center of the first void 110. The pair of intermediate leg sockets 152 is located along a radius $R_{152}$ as measured from the center of first void 110. The pair of intermediate leg sockets 154 is located on a radius $R_{154}$ as measured from the center of first void 110. Finally, the pair of outer leg sockets 160 is positioned along a radius as measured from the center of first void 110 along a radius of $R_{160}$. The dimensions for this particular embodiment of the present invention are shown in Table I below.

TABLE I

Exemplary Values

| Dimension | Value |
|---|---|
| $R_{150}$ | 22" |
| $R_{152}$ | 24" |
| $R_{154}$ | 26" |
| $R_{160}$ | 30" |
| S1 | 1.1" |
| Distance between 110 and 115 | 2" |
| Distance between 115 and 120 | 2" |

Also shown in FIG. 2D is an angle alpha along which the leg sockets 150, 152, 154 and 160 align. In this example, the angle alpha is approximately thirty degrees. The slot from the apex A provides communication through the voids 110, 115 and 120, as shown having a width S1.

Figure 2E:
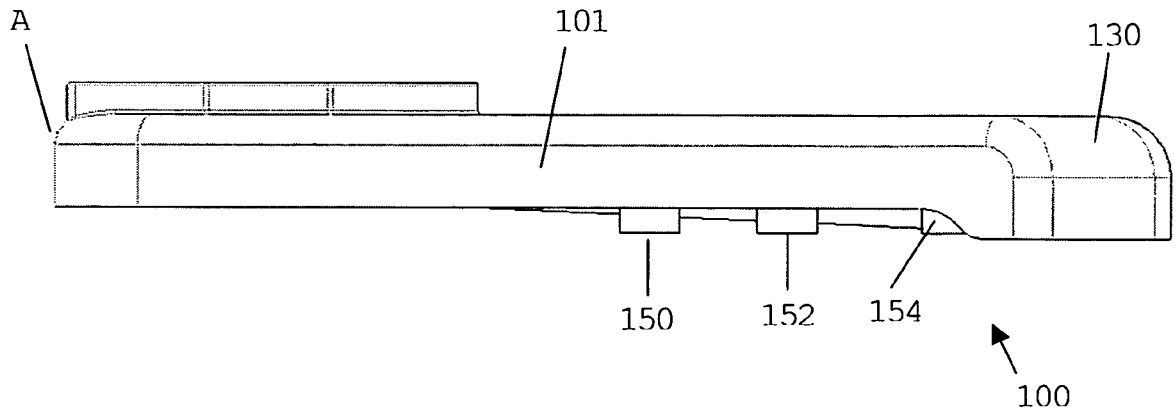
Figure 2F:
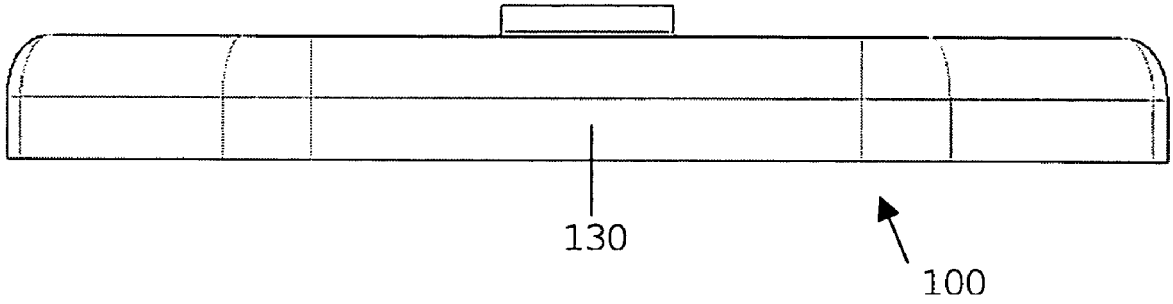

FIG. 2E shows a side view and FIG. 2F shows a front view of the embodiment of FIG. 2A. As shown, the support 101 has a nominal thickness of approximately 1.4 inches in this embodiment. Further, the support 101 in this embodiment is comprised of injected molded plastic having glass fiber reinforcement. However, any material adapted to provide sufficient support having sufficient strength to perform the functions as described herein would be capable of being used as would be realized by one of ordinary skill in the art having the benefit of this disclosure.

Figure 2G:
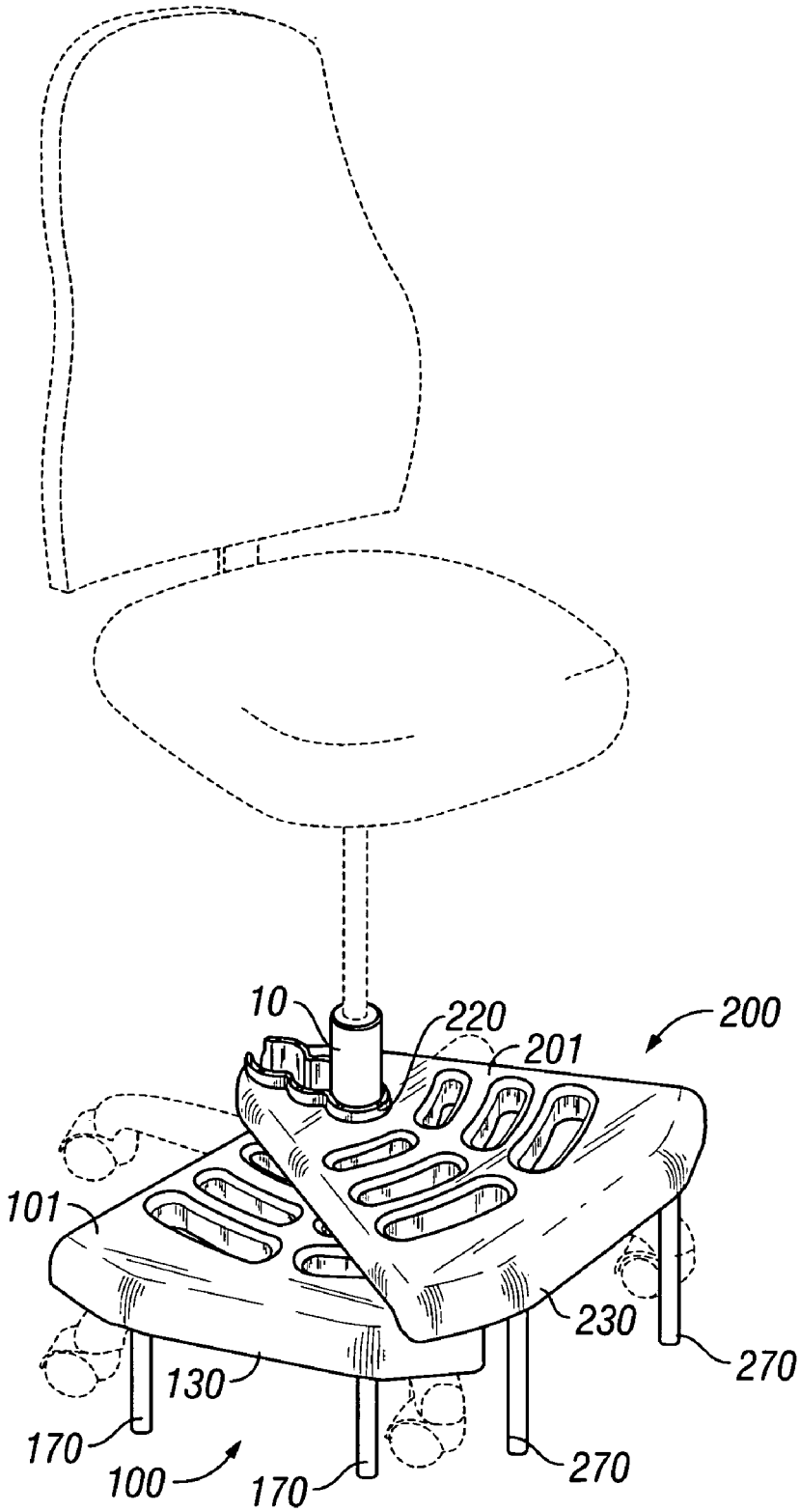

FIG. 2G shows the embodiment of the support assembly described above installed on a prior art seating device.

Figure 3A:
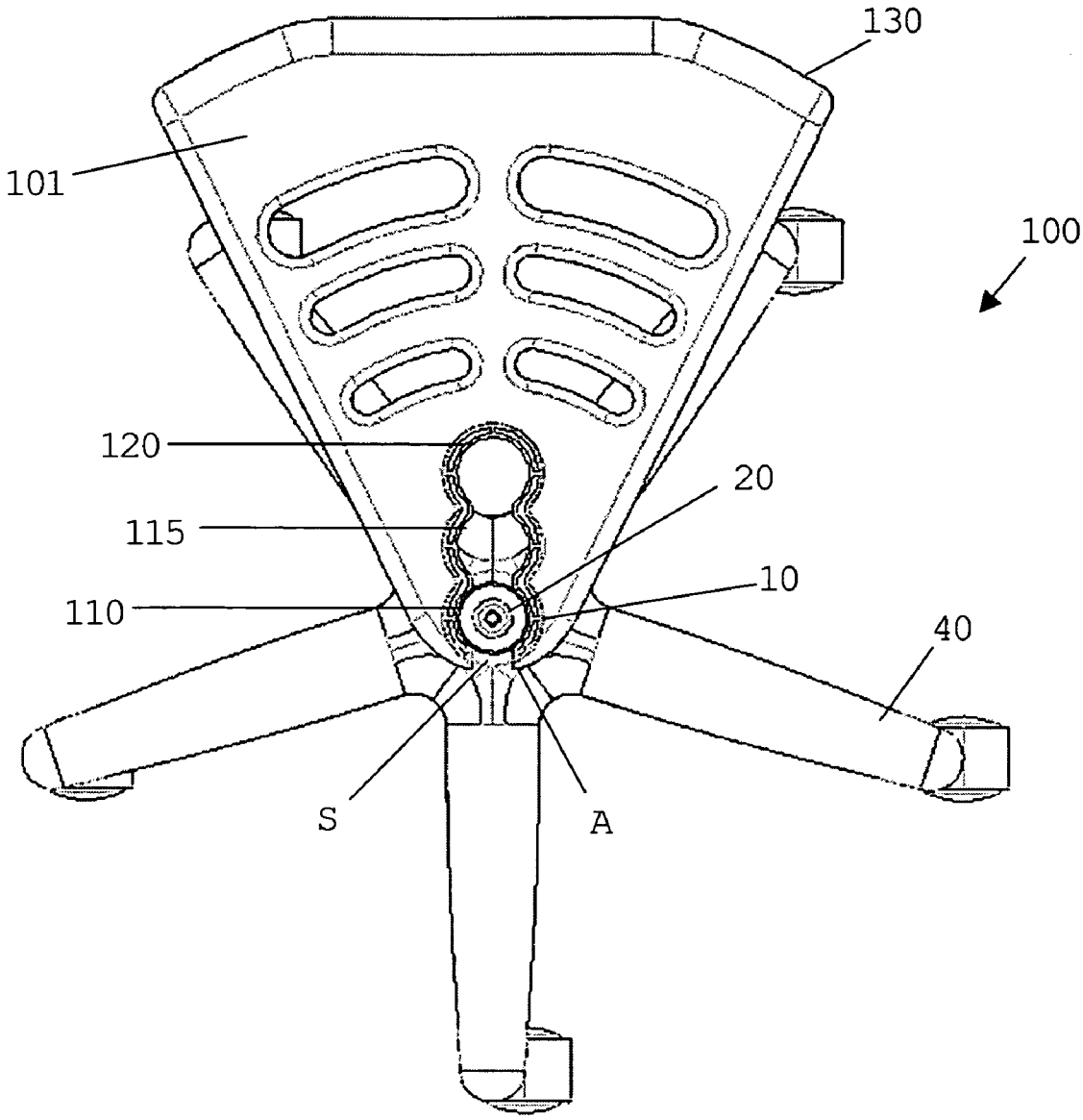
FIGS. 3A–3C show an embodiment of the present invention mounted base for a seating device.
Figure 3B:
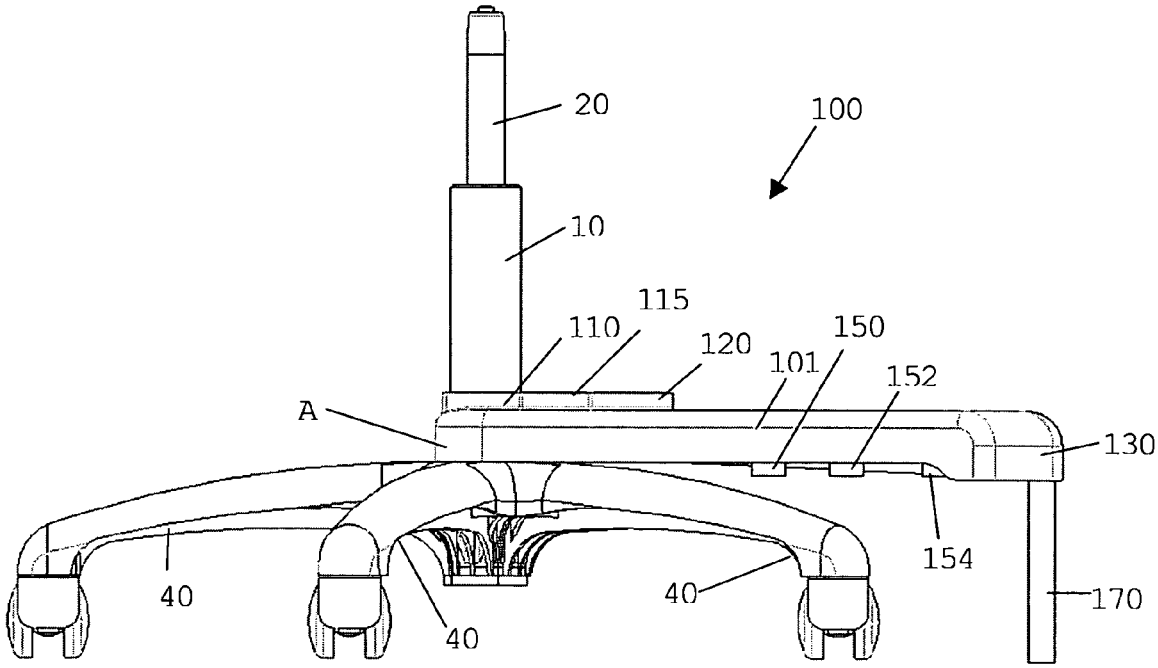
Figure 3C:
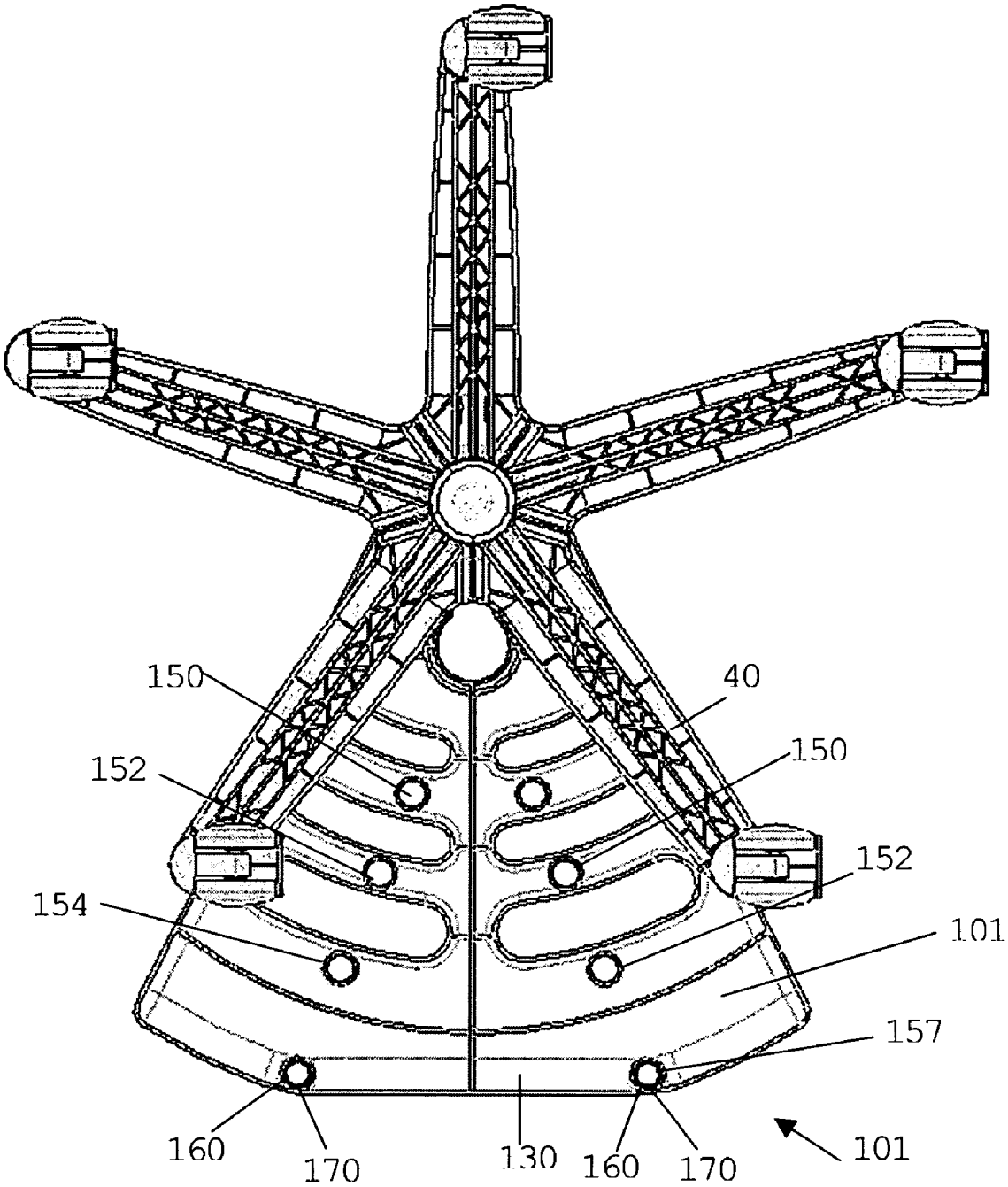

Referring now to FIGS. 3A–3C, the support assembly 100 of FIG. 2A is shown as installed on a prior art base 1 for a seating device. In FIG. 3A, the post 110 is shown engaged by first void 110 in support 101. As shown, the outer perimeter 130 extends beyond the length of legs 40.

Figure 7:
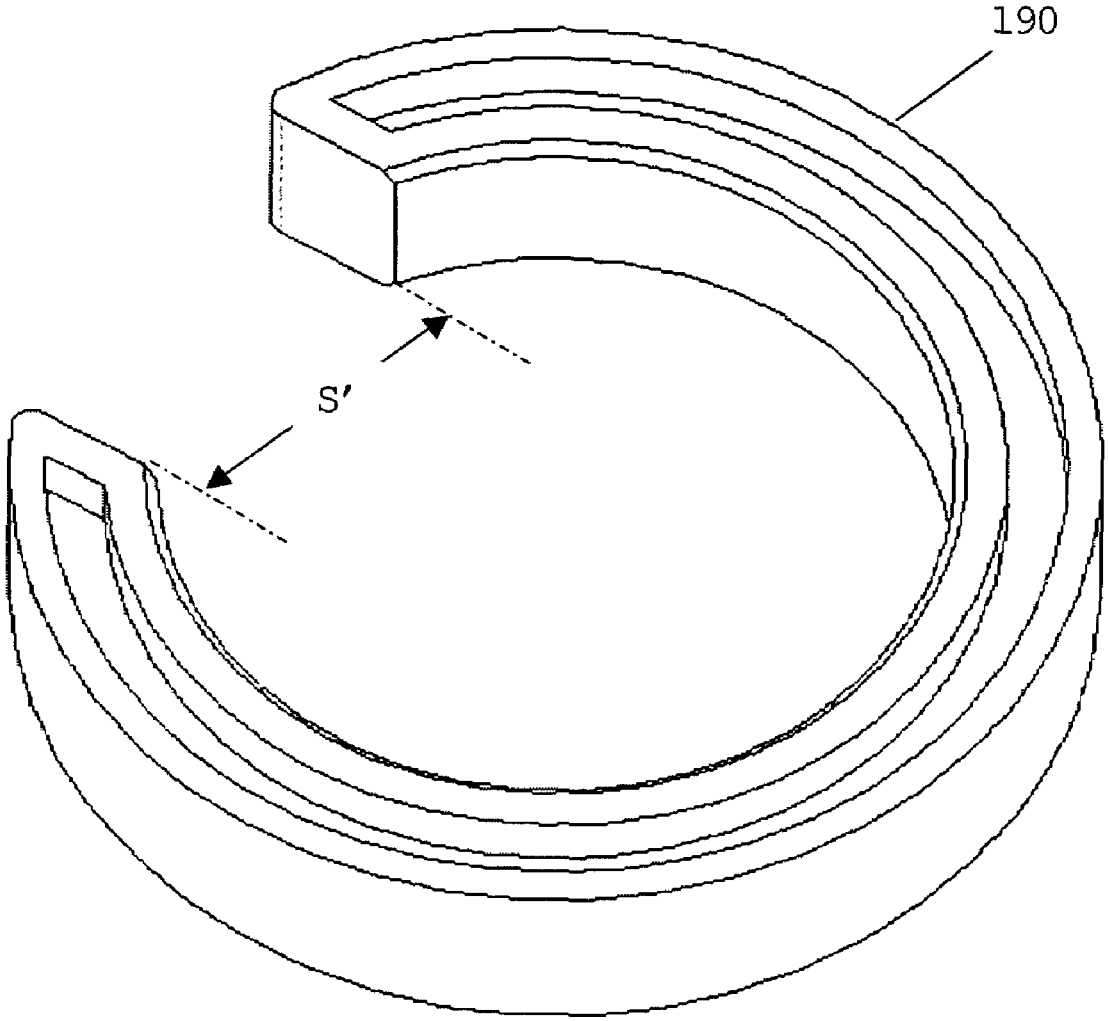
FIG. 7 shows a spacer used in embodiments of the present invention.

FIG. 3B shows a side view of FIG. 3A. In this embodiment, the support 101 is in direct contact with the substantially horizontal legs 40. However, depending on the configuration of the base 1 of the prior art seating device, in some applications a spacer (190 as shown in FIG. 7 described hereinafter) may be located between the support 101 and the top of this substantially horizontal legs 40 to equalize the height of the support legs 170 with the height of the base 1. This may be relatively important when utilizing multiple support assemblies in some embodiments, for example, to ensure the first support is relatively level with the floor prior to mounting additional supports atop the lower support.

In addition to the spacer 190 being applied to the post 10, other means for leveling the support may be utilized. For example, the legs 170 may comprise an adjustable length so that the support assembly 100 may be leveled with the floor. Further, the legs 170 may be telescopic in nature allowing the legs 170 to change in length.

As can be seen in FIG. 3B, leg 170 has been installed into outer leg socket 160. Legs 170 may be comprised of any desired length, for instance, six (6) inches, nine (9) inches or twelve (12) inches such that the support 101 is located a desired predetermined height from the floor. Further, the legs 170 may be comprised of any material sufficient to withstand the weight of the user, such as hollow aluminum, plastic, reinforced plastic, or even wood, and may be solid, hollow, or a combination of both. Further, the support 101 may be comprised of any material sufficient to withstand the downward force exerted by the user in the seating device. For instance, injection-molded plastic with 1½" glass-fill nylon may be utilized, as could any metal, wood, or other composite material.

With leg 170 positioned in the outer leg socket 160, the support 101 is capable of rotation 360° about post 10 such that the support 101 can be located in any desired location on the base 1 for the prior art seating device.

FIG. 3C shows a bottom view of FIG. 3A in which legs 170 are installed in the pair of outer leg sockets 160. As can be realized, the legs 170 do not interfere with the substantially horizontal legs 40 of the prior art seating device when the support 101 is rotated about post 10 in this configuration. However, if legs 170 were inserted in inner leg sockets 150, for example, legs 170 would contact substantially horizontal legs 40 when support 101 is rotated about post 10. In this way, when legs 170 are located in the inner leg socket 150, rotation about post 10 is restricted.

Substantially horizontal legs 40 of standard bases 1 for prior art seating devices have a length L of 22 inches, 24 inches, 26 inches and 28 inches. So, if the support 101 is to be utilized with various bases 1 having different leg lengths, intermediate leg sockets 152 and 154 are provided, which also are adapted to either allow the base 101 to rotate about post 10 or to restrict the rotation about post 10, depending on the leg length and the orientation of the support leg 170. Thus, the support leg 170 mating with the given leg sockets 150, 152, 154 or 160 may be adapted to restrict the rotational movement about the support 101 about post 110.

Referring again to FIG. 3B, it can be seen that support leg 170 provides vertical support for support 101 such that support 101 will not substantially deflect when a user applies weight via his or her feet to the support 101. In this way, the support leg 170 on support 101 provides ergonomic support for a user utilizing the seating device. By varying the length of the support leg 170, the support 101 may be raised to any desired height as measured from the floor. Similarly, with the support leg 170 in the appropriate leg socket, such as in the outer leg socket 160, the support 101 may be rotationally adjusted about post 10 to accommodate the user's desired preferred ergonomic position.

In this way, the support 101 of this embodiment of the present invention provides increased adjustability over prior art support apparatus such as the foot ring, as the support is both selectively rotatable and outwardly moveable with respect to the post 10 or column of the prior art seating device. The support assembly may be injection molded to decrease manufacturing costs. Further, as described above, the support assembly may be installed without the use of tools. Additionally, no disassembly of the seating device, such as the removal of the seat, is necessarily required, as some embodiment of the present invention include a slot S in the support 100. Further, the support 101 is less likely to cause the entire seating device to tilt when a user applies a downward force on the seating device when standing up, for example, at least partially because the support 101 in some embodiment is being supported by both the post 10/legs 40 of the prior art seating device on one end and the support legs 170 substantially on the other.

Referring to FIG. 3B, to install the support 101 on the prior art base 1 for the seating device, the support 101 is elevated from the floor such that the neck 20 of the post 10 may pass through slot S in the support 101. If it is desired that the post 10 is to engage the first void 110, then when first void 110 circumscribes neck 20, the support 101 is lowered such that the post 10 engages the first void 110. The support 101 may be lowered to the floor until the support leg 170 contacts the floor. Thus, the support 101 is at a predetermined height as determined by the length of support leg 170.

Figure 4:
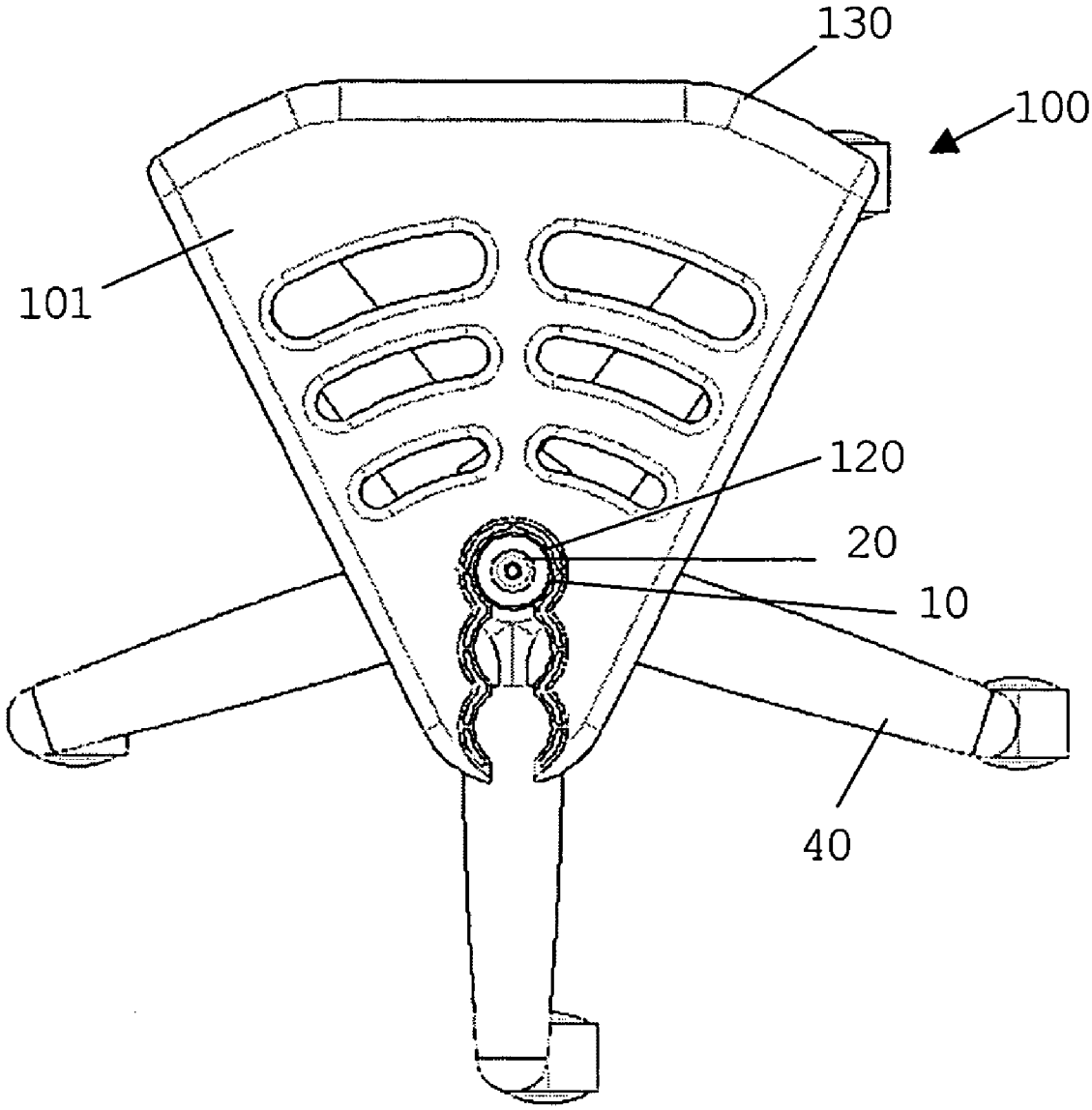
FIG. 4 shows an embodiment of the present invention in which the support has been moved inwardly with respect to the post of the prior art seating device.

Referring to FIG. 4, in some embodiments, the outer perimeter 130 of the support 101 may be adapted to be adjustable a distance from the center post 10 of the seating device when the support 101 is mounted on the center post 10. Changing the distance the outer perimeter 130 of support 101 extends from the center post 10 is accomplished by selective engagement of post 10 within one of the pluralities of voids 110, 115 and 120 in this embodiment. However, provided at least two voids exist within the support 101, the distance of outer perimeter 130 from the post 10 may be adjusted.

For example, comparing FIG. 3A to FIG. 4, the distance the outer perimeter 130 extends from the post 10 of the prior art seating device has been reduced as the first void 110 is in engagement with the post 10 in FIG. 3A and the second void 120 is in engagement with the post 10 in FIG. 4. This movement of the support 101 from the first void 110 engaging post 10 to the second void 120 engaging the post 10 reduces the distance the outer perimeter 130 extends from the post 10.

To configure the support 101 from the position as shown in FIG. 3A to that shown FIG. 4, the following steps are performed. The support 101 is lifted from the floor until slot S is in a plane with neck 20 of the prior art seating device. Once slot S is in a horizontal plane with the neck 20 of the prior art seating device, the neck 20 may be moved within slot S from the apex A to the first void 110, the intermediate void 115, and second void 120, as desired.

Once the neck 20 is in the desired void, the support 101 may be lowered such that the post 10 engages the desired void. In this way, the distance the outer perimeter 130 extends from post 10 may be altered. The plurality of voids thus provides a means for adjusting the distance the outer perimeter 130 extends from the post 10. That is, provided at least two voids exist in support 101 the distance the outer perimeter 130 extends from the post 10 may be adjusted. In this way, the support 101 may be utilized by seating devices having various sizes of bases, thus improving the flexibility of use of the disclosed support 101.

Adjusting the distance between the outer perimeter 130 and the post 10 may also perform another function: providing a means for selectively engaging one of the substantially horizontal legs 40 of the prior art seating device to selectively prevent rotation of the support 101 about post 10. For instance, if a support leg 170 is in an outer leg socket 160 and the post 10 engages the first void 110, in some embodiments The support 101 is free to rotate about the post 10 as the leg 170 does not interfere with the substantially horizontal leg 40 of the seating device. However, when the post 10 engages the second void 120 in the support 101, the support leg 170 in the outer leg socket 160 may contact any one of the plurality of substantially horizontal legs 40 of the seating device when the support 101 is rotated about post 10, provided the length L of the leg 40 is relatively long.

Referring back to FIGS. 2C and 2D, it can be seen that the plurality of leg sockets 150, 152, 154, and 160 provide another means for selectively preventing the rotation of the support 101 about post 10. For instance, in some embodiments, when the leg 170 is installed in outer leg socket 160, the support 101 is free to rotate about the base as the post 170 will not interfere with the substantially horizontal legs of the prior art seating device. However, when leg 170 is moved to the inner leg socket 150, the leg 170 contacts the substantially horizontal leg 40 of the prior art seating device, thus preventing rotation of the support 101 about the post 10.

It should be mentioned that leg 170 may be comprised of any material suitable to support the support 101. For instance, carbon reinforced plastics, aluminum or wood may be utilized by way of example and not by way of limitation. Further, each leg socket may comprise a shape complimentary to the periphery of leg 170. As shown in FIG. 2C for example, the leg sockets 150, 152, 154 and 160 have a substantially circular cross section which is slightly larger than the substantially circular cross section of leg 170 such that leg 170 may be inserted into and removed from any of the plurality of leg sockets, as desired.

It should also be mentioned that by providing a pair of inner leg sockets 150 and utilizing two legs 170 inserted into the inner leg sockets 150, one of the substantially horizontally extending legs 40 of the prior art seating device may be sandwiched or straddled between these inner leg sockets 150, further locking the support 101 to prevent rotation of the support 101 about the post 10.

Figure 5A:
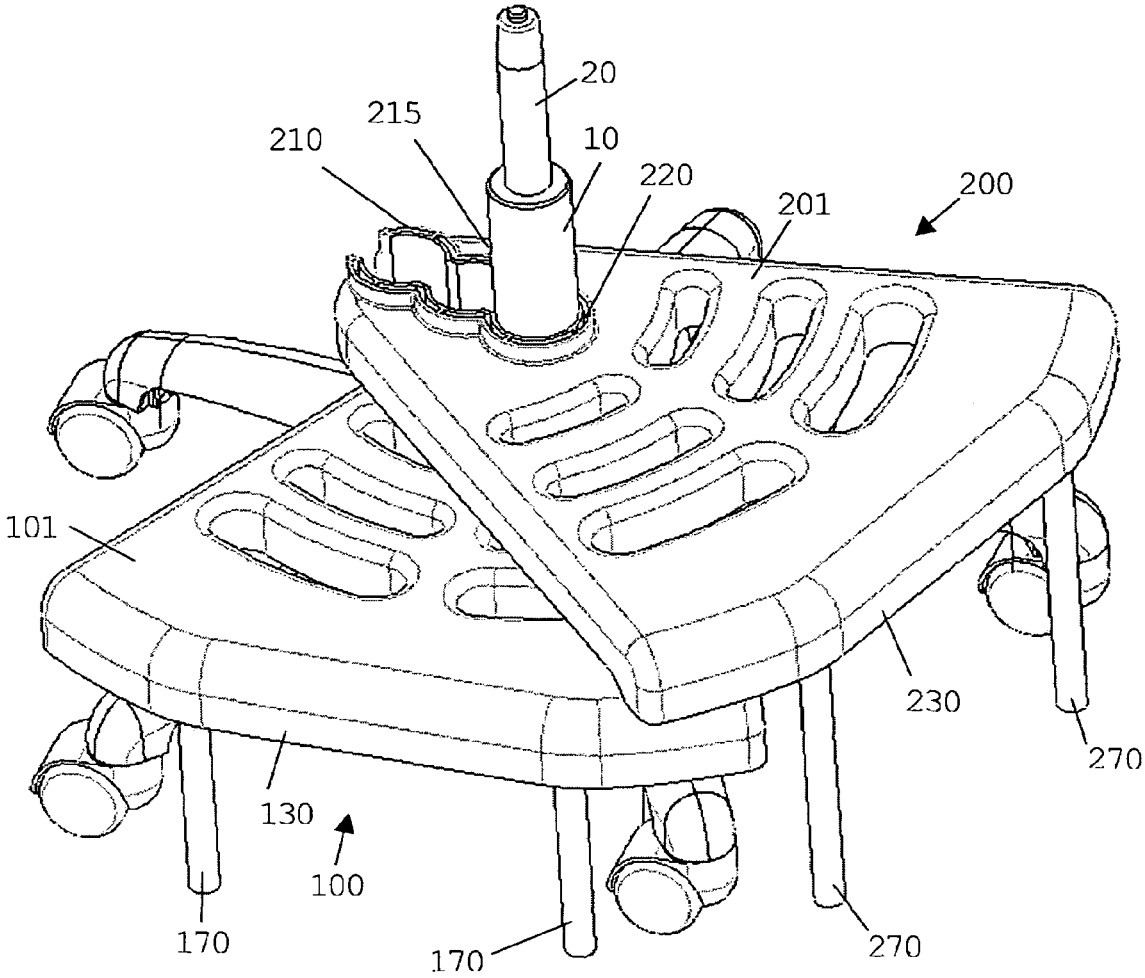
FIGS. 5A–C show an embodiment of the present invention having a plurality of supports.

Referring to FIG. 5A, an embodiment of the present invention is shown in which a second support assembly 200 is being utilized in conjunction with the first support assembly 100 described above. The second support assembly 200 comprises substantially similar features of first support assembly 100 described above with respect to the previous embodiments. However, by utilizing a plurality of support assemblies 100 and 200, a stair-stepped support assembly may be provided for the base 1 of a prior art seating device.

For instance, in FIG. 5A, the first support assembly 100 includes legs 170 extending for example six (6) inches in height. The second support assembly 200 is shown having legs 270, which are longer than legs 170 of the first support assembly. For instance, legs 270 may comprise nine (9) inches. In this way, the first support assembly 100 has a support 101, which is lower than support 201. Similarly, each support assembly 100 and 200 has means for selectively preventing the rotation of the support about the post 10 so that the plurality of supports may be substantially locked in position about the base of the prior art seating device.

Figure 5B:
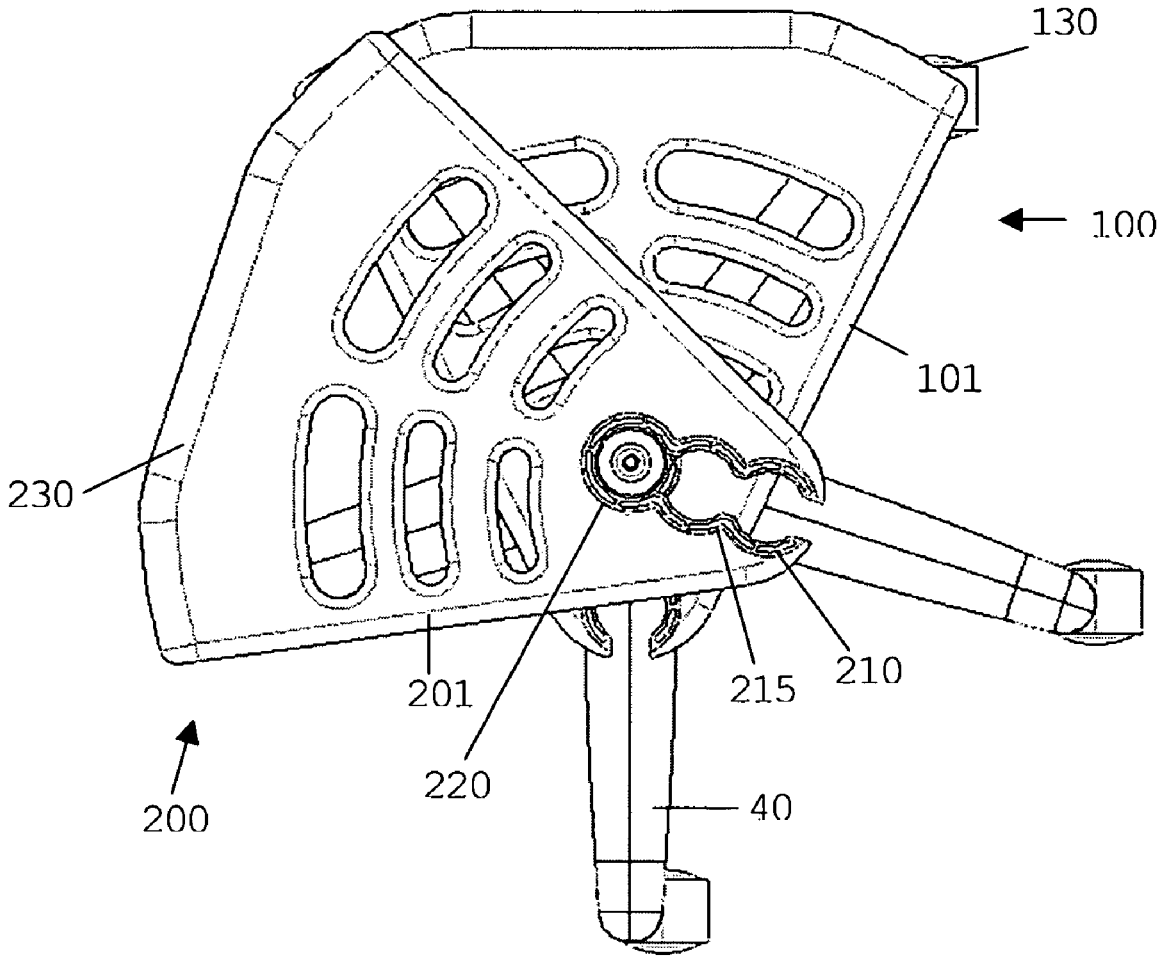
Figure 5C:
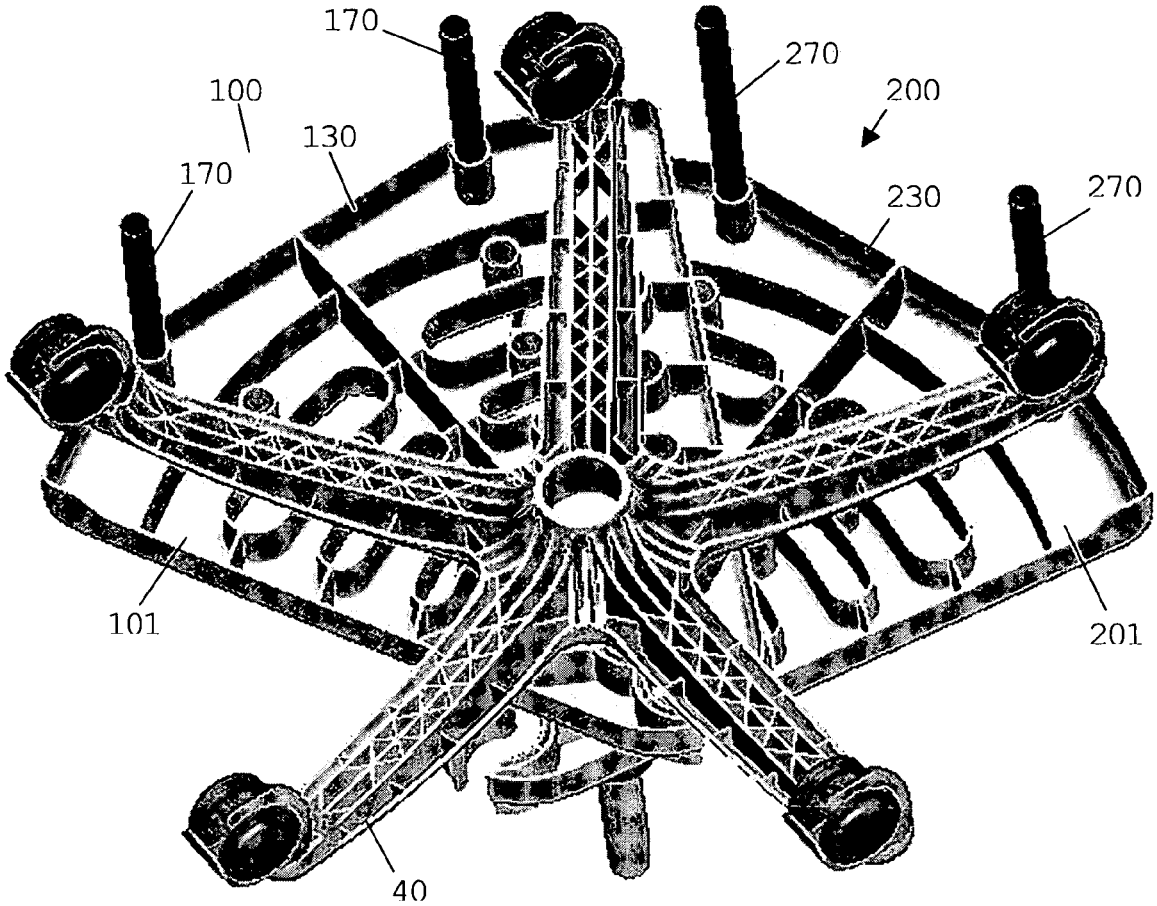

FIG. 5B shows a top view of the embodiment of FIG. 5A and FIG. 5C shows a bottom view of the same embodiment. It should be noted that although two support assembly 100 and 200 are shown in these Figures, any number of support assembly may be utilized in conjunction with each other to provide a desired support for a user seated in the prior art seating device, as would be realized by one of ordinary skill in the art having the benefit of this disclosure.

Figure 6A:
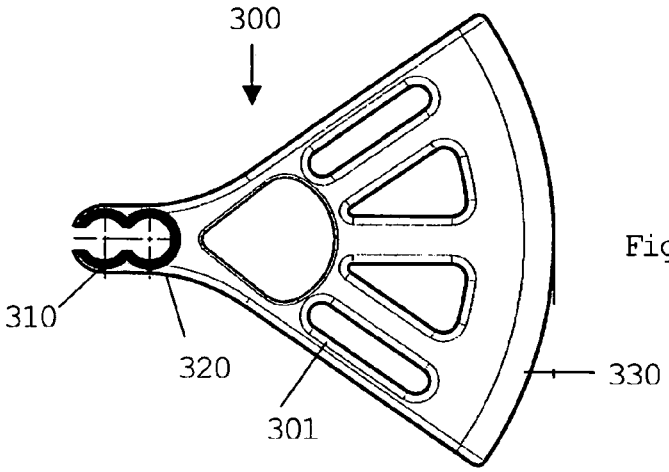
FIGS. 6A–6E show another embodiment of the present invention having a first void and then a second void.
Figure 6B:
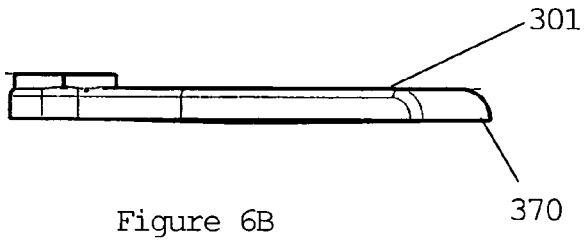
Figure 6C:
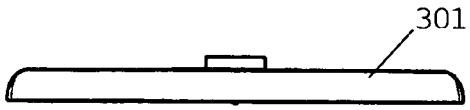
Figure 6D:
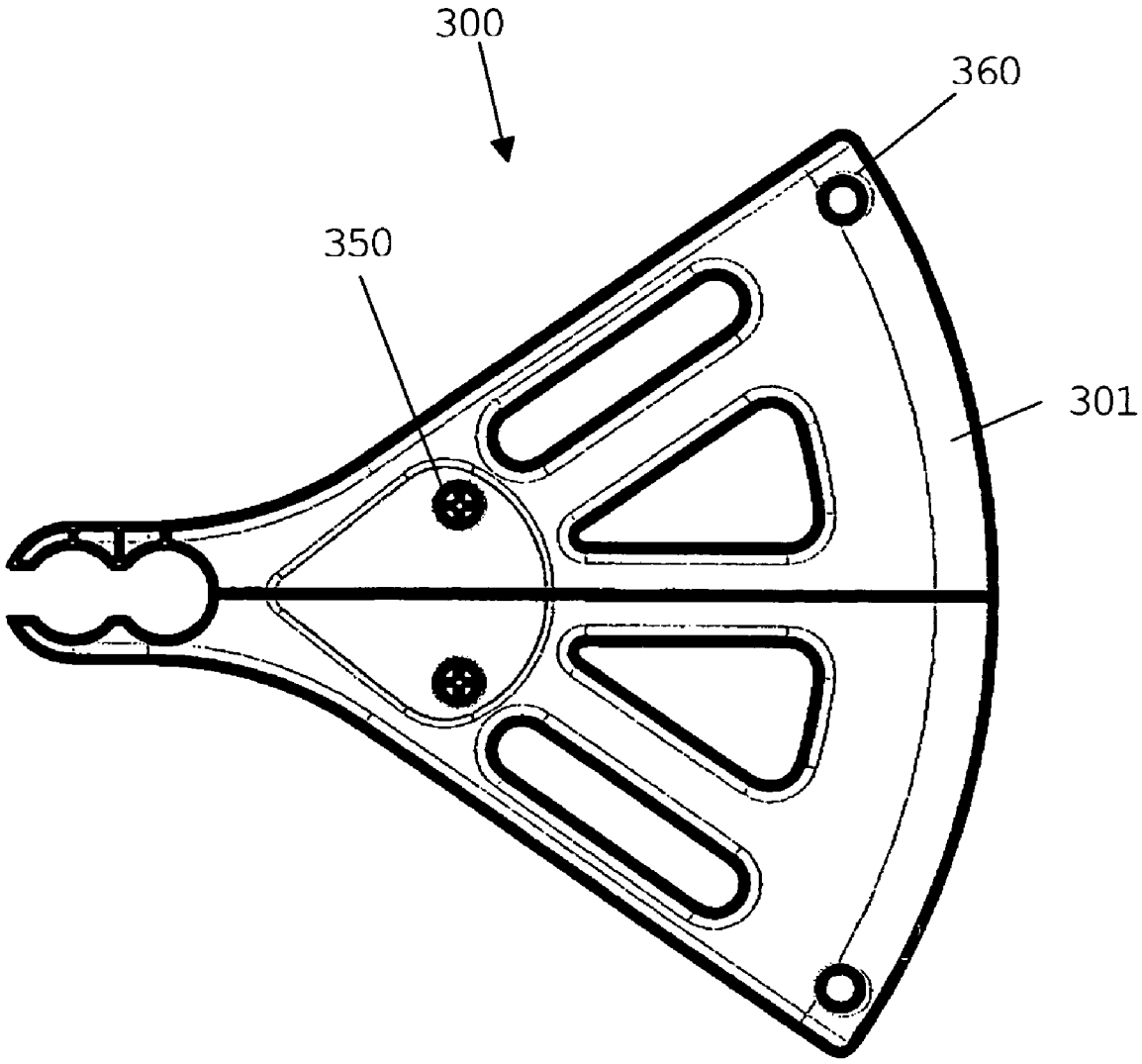
Figure 6E:
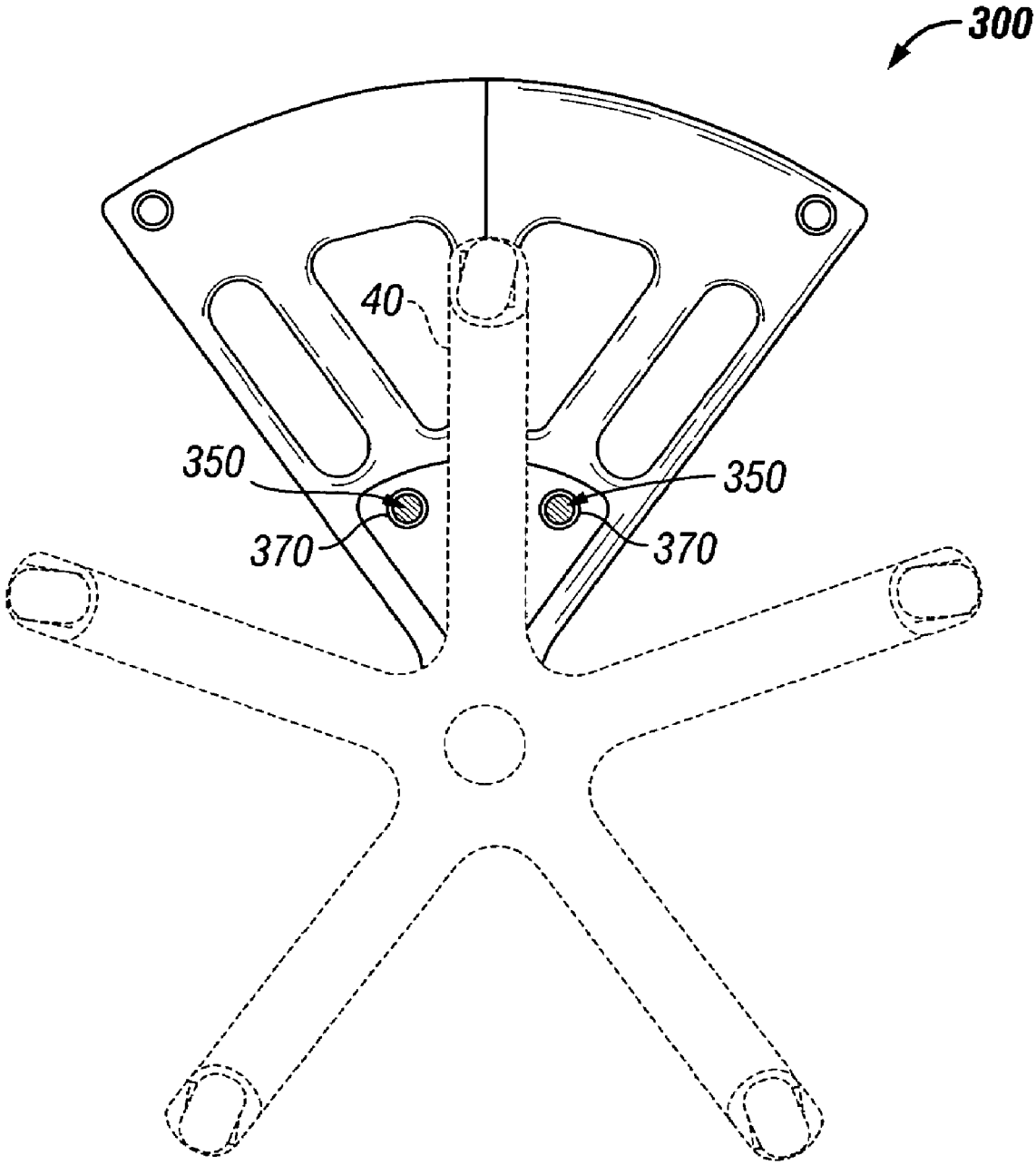

Referring to FIGS. 6A–6D, another embodiment of the present invention is shown. In this case, the plurality of voids includes a first void 310 and a second void 320 which operate similar to the first and second voids 110 and 120, described above. Similarly, as shown in FIG. 6D, the support 301 includes a pair of outer leg sockets 360 and a pair of inner leg sockets 350. As shown in FIG. 6E, with the support legs 370 inserted into the inner leg sockets 350, support legs 370 operate to sandwich or straddle one of the substantially horizontally extending legs 40 of the prior art seating device.

FIG. 7 shows the spacer 190 as described above for use in various embodiments of the present invention. The spacer 190 includes a slot S' adapted to mate with the neck 20 of the prior art seating device. The spacer 190 may then be lowered such that the post 10 of the prior art seating device is within the spacer 190 such that the spacer 190 is selectively locked thereupon. A support assembly 100 may be installed above the spacer 190 in some embodiments. In this way, the spacer 190 may provide means for leveling the support 101 of support assembly 100.

Referring to FIGS. 8A–8D, another embodiment of the present invention is shown wherein a plurality of supports are stackable. In this embodiment, the plurality of stackable support include and upper support 501, an intermediate support 601 and a lower support 701. Each of the upper support 501, intermediate support 601 and lower support 701 further comprise an integral leg 570, 670 and 770, respectively. For example, the upper support 501 has a radius bent which forms integral leg 570.

Each of the integral legs 570, 670, and 770 may comprise a notch. For example, as shown in FIG. 8B, upper support 501 comprises at least one notch 571. Notches 571 are adapted to each engage one of the substantially horizontal legs 40 of the prior art seating device.

Figure 8A:
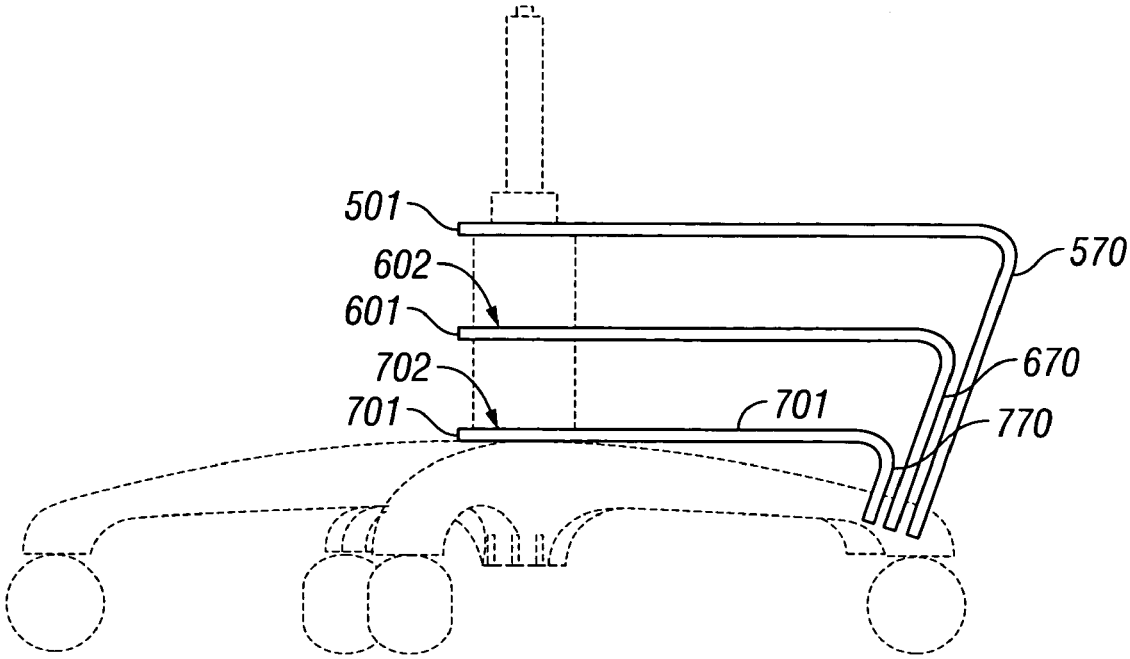
FIGS. 8A–8D show an embodiment of the present invention having ports and integral legs.
Figure 8B:
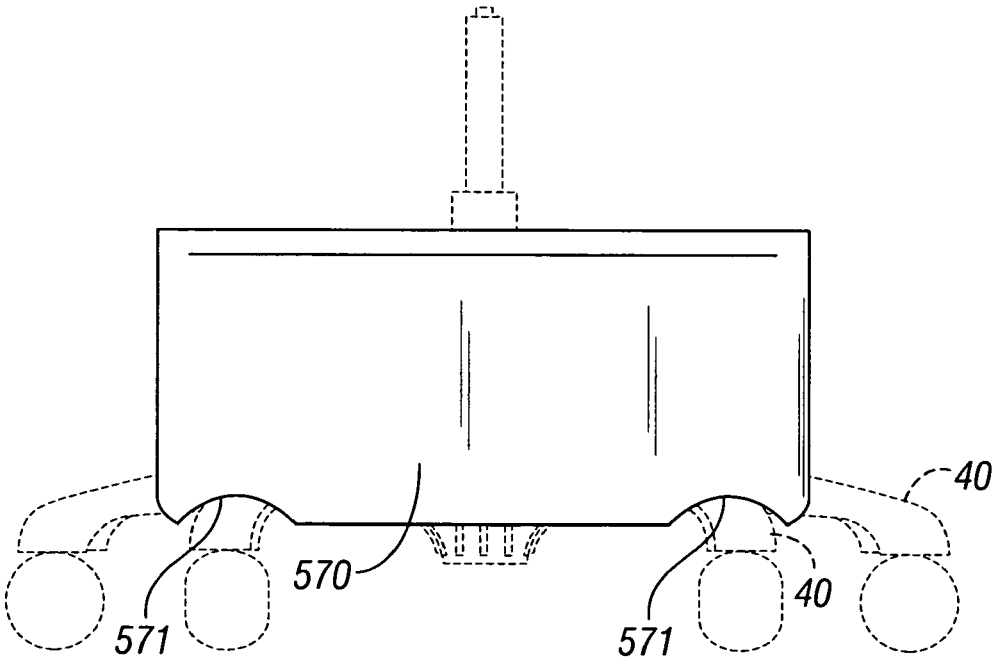
Figure 8C:
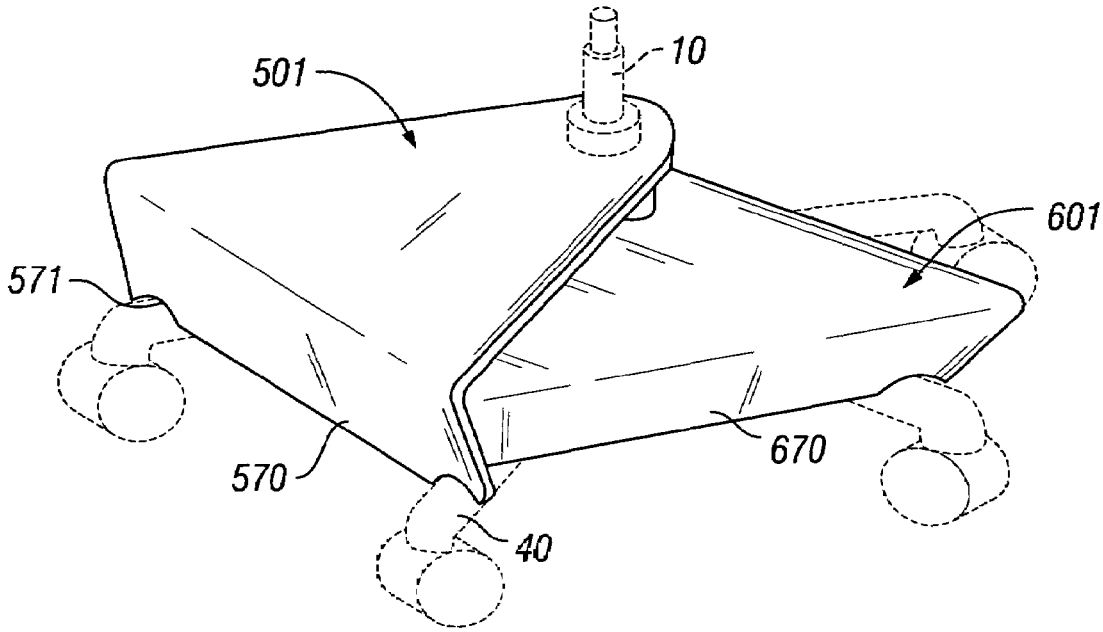

As shown in FIG. 8C, each of supports 501, 601, and 701 are adapted to rotate about post 10. In the example shown in FIG. 8C, the notches 571 in the legs 570 of the upper support 501 are in contact with a pair of substantially horizontal legs 40, which is a different pair than the pair of substantially horizontal legs 40 being contacted by the notches 671 of integral legs 670 on intermediate support 601. Not shown in this figure is lower support 701, which is located below intermediate support 601 and thus hidden from view.

As shown, intermediate support 601 is lower than upper support 501 such that the upper support 501 and intermediate support 601 are mounted on the base 1 in a stair-step fashion. I.e. the upper support 501 and the intermediate support 601 define a step on the base 1. Similarly, the lower support 701 could engage a different pair of substantially horizontal legs 40 to provide an additional step.

Again, as shown in FIG. 8A in this embodiment, the plurality of supports 501, 601 and 701, are also adapted to engage the same pair of substantially horizontal legs 40 such that the plurality of supports 501, 601, and 701 are stackable as shown in FIG. 8A.

Figure 8D:
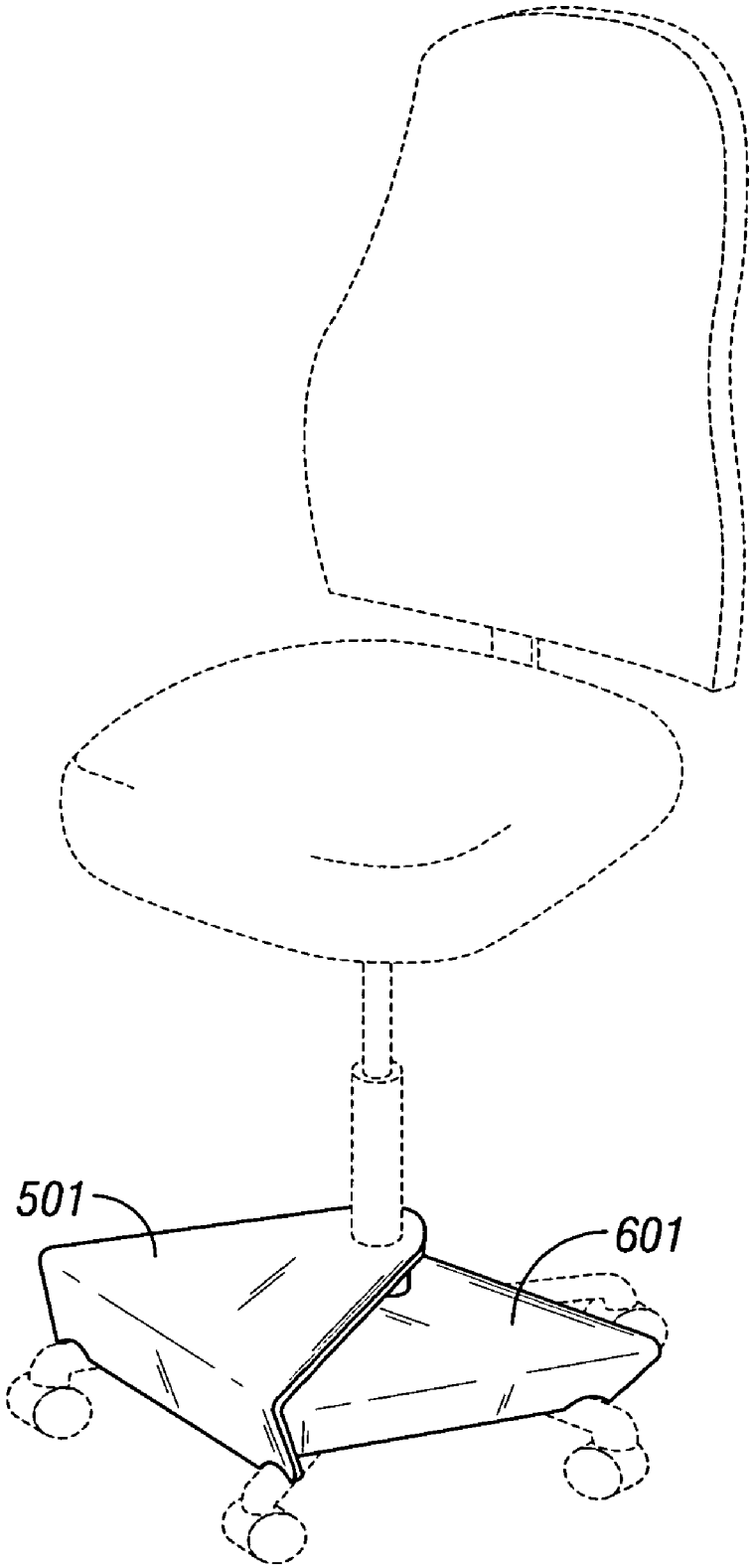

FIG. 8D shows the embodiment of FIG. 8A installed on a prior art seating device.

Figure 9:
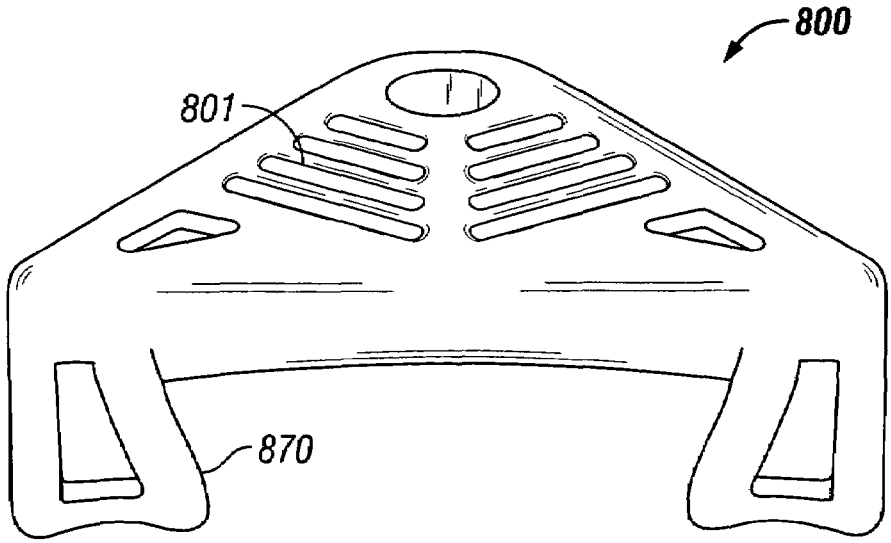
FIG. 9 shows another embodiment of the present invention having integral legs.

FIG. 9 shows an embodiment of the present invention of a support assembly 800 having a support 801 and integral legs 870. All other features of this embodiment are similar to those of the embodiment of FIG. 8A.

Although various embodiments have been shown and described, the invention is not so limited and will be understood to include all such modifications and variations as would be apparent to one skilled in the art.

The following table lists the description and the reference numbers as used herein and in the drawings attached hereto.

| Reference Number | Description |
|---|---|
| 1 | Base of Prior Art Seating Device |
| 10 | Post |
| 20 | Neck |
| 30 | Ring or Foot ring |
| 40 | Substantially Horizontal Leg of Prior Art Seating Device |
| 50 | Fastener |
| 60 | Caster |
| 100 | Support Assembly |
| 101 | Support |
| 110 | First Void |
| 115 | Intermediate Void |
| 120 | Second Void |
| 130 | Outer Perimeter of Support |
| 140 | Traction Grooves |
| 150 | Inner Leg Socket |
| 152 | Intermediate Leg Socket |
| 154 | Intermediate Leg Socket |
| 160 | Outer Leg Socket |
| 170 | Support Leg |
| 190 | Spacer |
| 200 | Second Support Assembly |
| 201 | Second Support |
| 270 | Second Leg |
| 501 | Upper Support |
| 570 | Integral Leg |
| 571 | Notch in Integral Leg |
| 601 | Intermediate Support |
| 701 | Lower Support |
| A | Apex |
| S | Slot |
| L | Length of Substantially Horizontal Leg of Prior Art Seating Device |
| R | Radii |

What is claimed is:

1. A support assembly attachable to a center post of a seating device havina a plurality of substantially horizontal legs, the support assembly comprising:

a support having a first void and a second void therethrough, the support being substantially triangular and having an end comprising an apex, and an outer perimeter; and at least one support leg adapted to be attachable to the support, the first void selectively attachable to the post to define a first position of the support, the second void being located between the first void and the outer perimeter, the second void attachable to the post to define a second position of the support, a slot in the apex selectively attachable to the post, the slot also providing communication between the voids, such that the perimeter moves outwardly from the post when the support is moved from second position to the first position.

2. The assembly of claim 1 wherein, the slot in the apex is selectively attachable to a neck on the post and the first void is substantially at the apex.

3. The assembly of claim 1 in which the at least one support leg is selectively attachable to an underside of the support at a first location or a second location, the second location being positioned between a first leg socket and the outer perimeter of the Support.

4. The assembly of claim 3 in which the first location comprises the first leg socket and the second location comprises a second leg socket.

5. The assembly of claim 4 further comprising an intermediate position defined by the leg engaging an intermediate leg socket located between the first and second leg socket.

6. The assembly of claim 5 in which the support leg is adapted to interfere with one of the substantially horizontal legs of the seating device when the support leg is attached to the first leg socket, thus substantially preventing rotation of the support about the post.

7. The assembly of claim 6 in which the support is rotatable about the post when the support leg is attached to the support at the second leg socket.

8. The assembly of claim 7 in which the support and the leg are each comprised of a material selected from the group of wood, aluminum or plastic.

9. The assembly of claim 1 in which the at least one support legs further comprises a pair of support legs, a first location comprising a first pair of leg sockets each equidistant from the post, and a second location comprising a second pair of leg sockets each equidistant from the post, wherein the support legs are adapted to straddle one of the substantially horizontal legs of the seating device when the support legs are attached to the first leg sockets, thus substantially hampering rotation of the support about the post, the support being rotatable about the post when the pair of support legs engages the pair of second leg sockets.

10. The assembly of claim 1 further comprising a second support assembly having a second support having a first void and a second void therethrough, the second support having an end and an outer perimeter; and at least one support leg adapted to be attachable to the second support, the first void selectively attachable to the post to define a first position of the second support, the second void being located between the first void and the outer perimeter, the second void attachable to the post to define a second position of the second support, such that the perimeter moves outwardly from the post when the support is moved from second position to the first position, wherein the support leg of the first support assembly and the support leg of the second support assembly have dissimilar lengths thus providing a step arrangement for the seating device.

11. The assembly of claim 1 in which the length of the at least one leg is selected from the group of six inches, nine inches, or twelve inches.

12. The assembly of claim 1 in which the support comprises tread surfaces.

13. The assembly of claim 1 in which the at least one support leg is integral with the support.

14. The assembly of claim 1 in which each of the at least one support leg is selectively connectable to the support at a first location, each leg also connectable to the support at a second location between the first location and the outer perimeter, wherein the support is rotatable about the post when the support leg is connected to the support at the second location, the support substantially prevented from rotating about the post when the support leg is connected to the support at the first location.

15. The support assembly of claim 14 in which the support leg is adapted to substantially interfere with at least one substantially horizontal leg of the seating device when the support leg is connected to the support at the first location.

16. The support assembly of claim 15 in which the at least one support leg is selectively attachable to an underside of the support, the first location being a first leg socket adapted to selectively engage the leg, the second location being a second leg socket adapted to selectively engage the support leg.

17. The support assembly of claim 16 in which the support comprises a first void and a second void therethrough, the support being substantially triangular having an apex, wherein the first void selectively engages the post to define a first position of the support, the second void being located between the first void and the outer perimeter, the second void engaging the post to define a second position of the support, such that the perimeter moves outwardly from the post when the support is moved from second position to the first position.

18. The support assembly of claim 15 in which the at least one support leg comprises a pair of support legs and the second location is defined by a pair of support leg sockets such dint the pair of support legs are adapted to straddle one of the substantially horizontal legs of the seating device when the support is in the second position.

19. The support assembly of claim 15, in which the at least one leg is integral to the support.

20. The support assembly of claim 15, further comprising a second support assembly having a second support and a second leg having a length dissimilar to a length of the first leg, the first and second support assemblies adapted to define a step of the base of the seating device.

21. A support assembly attachable to a center post of a seating device having a plurality of substantially horizontal legs the support assembly comprising:

a support having a first void and a second void therethrough the support having an end and an outer perimeter; and at least one support leg adapted to be attachable to the support, the first void selectively attachable to the post to define a first position of the support the second void being located between the first void and the outer perimeter, the second void attachable to the post to define a second position of the support, such that the perimeter moves outwardly from the post when the support is moved from second position to the first position.

a second support assembly having a second support with a second leg, the first support and the second support being substantially parallel.

22. The assembly of claim 21 in which the second support comprises radial traction grooves.

23. The assembly of claim 21 in which the support leg comprises at least one notch adapted to engage at least one substantially horizontal leg of the seating device.

24. The assembly of claim 21 in which the first leg is a first integral leg and the second leg is a second integral leg.

25. The assembly of claim 24 in which the first integral leg and the second integral leg each comprise at least one notch adapted to selectively mate with one of the substantially horizontal legs of the seating device.

26. The assembly of claim 25 in which a length of first integral leg and a length of the second integral leg are dissimilar.

27. The assembly of claim 26 in which the first and second support assemblies are stackable, when each notch of each integral leg engages the same substantially horizontal leg of the seating device.

28. The assembly of claim 26 in which the first and second support assemblies form a stair step in combination when the first leg and the second leg engage different substantially horizontal legs of the seating device.

29. A method providing an adjustable support for a user when the user is seated on a seating device, the seating device having a neck on a post supported by a plurality of substantially horizontal legs, comprising:

providing a support assembly having a support with a first void and a second void therethrough, a slot connecting the first and second voids the support having an end and an outer perimeter, and at least one support leg adapted to be attachable to the support at a first location and a second location between the first location and the outer perimeter, the first void selectively engaging the post to define a first position of the support, the second void being located between the first void and the outer perimeter, the second void engaging the post to define a second position of the support; inserting at least one support leg at the second location;

engaging the slot with the neck of the post until the neck is circumscribed by the first void;

lowering the support until post engages the first void and the leg contacts a floor; and supporting the user's feet with the support.

30. The method of claim 29 further comprising rotating the support about the post to a predetermined location.

31. The method of claim 30 further comprising:

raising the support until the slot engages the neck;

pushing inwardly until the neck circumscribes the second void; and lowering the support until the post engages the second void and the leg contacts the floor.

32. The method of claim 30 further comprising:

removing the at least one leg from the second location; and attaching the at least one support leg at the first location to prevent the rotation of the support about the post, the at least one leg in interference with the substantiality horizontal leg of the seating device.

33. A support assembly attachable to a center post of a seating device having a plurality of substantially horizontal legs, the support assembly comprising:

a support having a first void and a second void therethrough, the support having an end and an outer perimeter; and at least one support leg adapted to be attachable to the support, the first void selectively attachable to the post to define a first position of the support, the second void being located between the first void and the outer perimeter, the second void attachable tg the post to define a second position of the support, such that the perimeter moves outwardly from the post when the support is moved from second position to the first position, in which the at least one leg is telescopic having an adjustable length.

34. An adjustable support assembly for a seating device having a plurality of substantially horizontal legs and a center post, the adjustable support assembly comprising:

a substantially triangular support having a first void and a second void therethrough, the support having an apex and an outer perimeter, a slot providing communication from the apex through the first void to the second void; and a pair of support legs adapted to be attachable to an underside of the support, the first void selectively attachable to the post to define a first position of the support, the second void being located between the first void and the outer perimeter, the second void engageable with the post to define a second position of the support, such that the perimeter moves outwardly from the post when the support is moved train second position to the first position, in which the pair of support legs is selectively attachable to the underside of the support at a pair of first leg sockets at a first location or a second pair of leg sockets at a second location, the second location being positioned between the first leg socket and the outer perimeter of the support, in which the pair of support legs is adapted to straddle one of the substantially horizontal legs of The seating device when the pair of support legs is attached to the first pair of leg sockets, thus substantially preventing rotation of the support about The post, the support being rotatable about the post when the pair of support legs is attached to the second pair of leg sockets.

35. A support assembly for a seating device having a plurality of substantially horizontal legs and a center post, the support assembly comprising:

a support having a first void and a second void therethrough, the support having an end and an outer perimeter; and at least one support leg adapted to be attachable to the support, the first void selectively engaging the post to define a first position of the support, the second void being located between the first void and the outer perimeter, the second void engaging the post to define a second position of the support, such that the perimeter moves outwardly from the post when the support is moved from second position to the first position.

36. A support assembly attachable to a center post of a seating device having a plurality of substantially horizontal legs, the support assembly comprising:

a first support having a first void and a second void therethrough, the first support having an end and an outer perimeter; and at least one support leg adapted to be attachable to the support, the first void selectively attachable to the post to define a first position of the support, the second void being located between the first void and the outer perimeter, the second void attachable to the post to define a second position of the support, such that the perimeter moves outwardly from the post when the support is moved from second position to the first position;

a second support assembly having a second support having a first void and a second void therethrough, the second support having an end and an outer pen meter; and at least one support leg adapted to be attachable to the second support, the first void selectively attachable to the post to define a first position of the second support the second void being located between the first void and the outer perimeter, the second void attachable to the post to define a second position of the second support, such that the perimeter moves outwardly from the post when the support is moved from second position to the first position, wherein the support leg of the first support assembly and the support leg of the second support assembly have dissimilar lengths thus providing a step arrangement for the seating device.

37. An adjustable support assembly attachable to a center post of a seating device having a plurality of substantially horizontal legs, the adjustable support assembly comprising:

a substantially triangular support having a first void and a second void therethrough, the support having an apex and an outer perimeter, a slot providing communication from the apex through the first void to the second void; and a pair of support legs adapted to be attachable to an underside of the support, the first void selectively attachable to the post to define a first position of the support, the second void being located between the first void and the outer perimeter, the second void attachable to the post to define a second position of the support, such that the perimeter moves outwardly from the post when the support is moved from second position to die first position, in which the pair of support legs is selectively attachable to the underside of the support at a pair of first leg sockets at a first location or a second pair of leg sockets at a second location, the second location being positioned between the first leg socket and the outer perimeter of the support, in which the pair of support legs is adapted to straddle one of the substantially horizontal legs of the seating device when the pair of support legs is attached to the first pair of leg sockets, thus substantially preventing rotation of the support about the post the support being rotatable about the post when the pair of support legs is attached to the second pair of leg sockets.

* * * * *

UNITED STATES PATENT AND TRADEMARK OFFICE

CERTIFICATE OF CORRECTION

PATENT NO. : 7,036,886 B2
APPLICATION NO. : 10/835170
DATED : May 2, 2006
INVENTOR(S) : Mark E. Benden et al.

It is certified that error appears in the above-identified patent and that said Letters Patent is hereby corrected as shown below:

| | |
|---|---|
| Col. 11, line 50 | change “havina” to --having-- |
| Col. 13, line 30 | change “dint” to --that-- |
| Col. 13, line 39 | change “of” to --on-- |
| Col. 13, line 42 | insert a --,-- after “legs” |
| Col. 13, line 44 | insert a --,-- after “through” |
| Col. 13, line 57 | change the “.” to --,-- |
| Col. 14, line 20 | insert a --,-- after “voids” |
| Col. 14, line 63 | change “tg” to --to-- |
| Col. 15, line 19 | change “train” to --from-- |
| Col. 15, line 26 | change “The” to --the-- |
| Col. 15, line 29 | change “The” to --the-- |
| Col. 15, line 39 | change “engaging” to --engageable with-- |
| Col. 15, line 42 | change “engaging” to --engageable with-- |
| Col. 16, line 10 | change “pen meter” to --perimeter-- |

UNITED STATES PATENT AND TRADEMARK OFFICE

CERTIFICATE OF CORRECTION

PATENT NO. : 7,036,886 B2
APPLICATION NO. : 10/835170
DATED : May 2, 2006
INVENTOR(S) : Mark E. Benden et al.

It is certified that error appears in the above-identified patent and that said Letters Patent is hereby corrected as shown below:

Col. 16, line 41 change "die" to --the--

Signed and Sealed this

Eleventh Day of March, 2008

JON W. DUDAS
*Director of the United States Patent and Trademark Office*